US009488929B2

(12) United States Patent
Onishi

(10) Patent No.: US 9,488,929 B2
(45) Date of Patent: Nov. 8, 2016

(54) IMAGE FORMING UNIT AND IMAGE FORMING APPARATUS

(71) Applicant: Oki Data Corporation, Tokyo (JP)

(72) Inventor: Akihito Onishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/684,979

(22) Filed: Apr. 13, 2015

(65) Prior Publication Data

US 2015/0293471 A1 Oct. 15, 2015

(30) Foreign Application Priority Data

Apr. 15, 2014 (JP) ..... 2014-084046

(51) Int. Cl.
*G03G 15/08* (2006.01)

(52) U.S. Cl.
CPC ..... *G03G 15/0808* (2013.01)

(58) Field of Classification Search
None
See application file for complete search history.

(56) References Cited

U.S. PATENT DOCUMENTS 5,557,060 A * 9/1996 Okada ..... G03G 15/0806 399/284
5,655,197 A * 8/1997 Okada ..... G03G 15/0806 399/281
2002/0064408 A1* 5/2002 Akiba ..... G03G 21/105 399/359
2002/0085861 A1* 7/2002 Izumi ..... G03G 15/0812 399/274
2015/0227077 A1* 8/2015 Kubo ..... G03G 15/0921 399/273
2015/0234315 A1* 8/2015 Adachi ..... G03G 21/1803 399/283

FOREIGN PATENT DOCUMENTS

JP 2009-116153 A 5/2009

* cited by examiner

*Primary Examiner* — David Gray
*Assistant Examiner* — Sevan A Aydin
(74) *Attorney, Agent, or Firm* — Panitch Schwarze Belisario & Nadel LLP

(57) ABSTRACT

An image forming unit suppressing occurrences of jitters, includes an image carrier rotating by drive force transmitted via a first route to form an electrostatic latent image, and a developer carrier having an elastic layer carrying a developer on a surface thereof and rotating by drive force transmitted via a second route to develop the electrostatic latent image. The electrostatic latent image is developed with the developer under a development condition that, with the elastic layer of a thickness from 0.5 mm to 2.5 mm, the developer carrier is rotated with a circumferential speed ratio to the image carrier in a range from 1.10 to 1.45, or that, with the elastic layer of a thickness more than 2.5 mm but not more than 5.0 mm, the developer carrier is rotated with a circumferential speed ratio to the image carrier in a range from 1.10 to 1.24.

9 Claims, 15 Drawing Sheets

FIG.11

| CIRCUMFERENTIAL SPEED OF PHOTOSENSITIVE DRUM | | 86[mm/s] | | | | | | | 191[mm/s] | | | | | | |
|---|---|---|---|---|---|---|---|---|---|---|---|---|---|---|---|
| THICKNESS OF ELASTIC LAYER | | 0.3[mm] | 0.5[mm] | 1.0[mm] | 2.0[mm] | 2.5[mm] | 3.0[mm] | 5.0[mm] | 0.3[mm] | 0.5[mm] | 1.0[mm] | 2.0[mm] | 2.5[mm] | 3.0[mm] | 5.0[mm] |
| CIRCUMFERENTIAL SPEED RATIO OF DEVELOPING ROLLER WITH RESPECT TO PHOTOSENSITIVE DRUM | 1.60 | × | × | × | × | × | × | × | ○ | ○ | ○ | △ | △ | × | × |
| | 1.45 | △ | △ | △ | △ | △ | × | × | ○ | ○ | ○ | ○ | ○ | × | × |
| | 1.34 | ○ | ○ | ○ | ◎ | ○ | × | × | ○ | ○ | ○ | ◎ | ◎ | △ | △ |
| | 1.24 | ○ | ○ | ○ | ◎ | ◎ | △ | △ | ○ | ○ | ○ | ◎ | ◎ | ○ | ○ |
| | 1.10 | ○ | ○ | ○ | ○ | ○ | △ | △ | ○ | ○ | ○ | ○ | ○ | ○ | ○ |
| | 1.05 | ■ | ■ | ■ | ■ | ■ | ■ | ■ | ■ | ■ | ■ | ■ | ■ | ■ | ■ |

FIG.12

| CIRCUMFERENTIAL SPEED OF PHOTOSENSITIVE DRUM | | 86[mm/s] | | | | | | | 191[mm/s] | | | | | | |
|---|---|---|---|---|---|---|---|---|---|---|---|---|---|---|---|
| THICKNESS OF ELASTIC LAYER | | 0.3[mm] | 0.5[mm] | 1.0[mm] | 2.0[mm] | 2.5[mm] | 3.0[mm] | 5.0[mm] | 0.3[mm] | 0.5[mm] | 1.0[mm] | 2.0[mm] | 2.5[mm] | 3.0[mm] | 5.0[mm] |
| CIRCUMFERENTIAL SPEED RATIO OF DEVELOPING ROLLER WITH RESPECT TO PHOTOSENSITIVE DRUM | 1.60 | ■ | ○ | ○ | ○ | ○ | ○ | ○ | ■ | ○ | ○ | ○ | ○ | ○ | ○ |
| | 1.45 | ■ | ○ | ○ | ○ | ○ | ○ | ○ | ■ | ○ | ○ | ○ | ○ | ○ | ○ |
| | 1.34 | ■ | ○ | ○ | ○ | ○ | ○ | ○ | ■ | ○ | ○ | ○ | ○ | ○ | ○ |
| | 1.24 | ■ | ○ | ○ | ○ | ○ | ○ | ○ | ■ | ○ | ○ | ○ | ○ | ○ | ○ |
| | 1.10 | ■ | ○ | ○ | ○ | ○ | ○ | ○ | ■ | ○ | ○ | ○ | ○ | ○ | ○ |
| | 1.05 | ■ | ○ | ○ | ○ | ○ | ○ | ○ | ■ | ○ | ○ | ○ | ○ | ○ | ○ |

FIG.13

| CIRCUMFERENTIAL SPEED OF PHOTOSENSITIVE DRUM | | 86[mm/s] | | | | | | | 191[mm/s] | | | | | | |
|---|---|---|---|---|---|---|---|---|---|---|---|---|---|---|---|
| THICKNESS OF ELASTIC LAYER | | 0.3[mm] | 0.5[mm] | 1.0[mm] | 2.0[mm] | 2.5[mm] | 3.0[mm] | 5.0[mm] | 0.3[mm] | 0.5[mm] | 1.0[mm] | 2.0[mm] | 2.5[mm] | 3.0[mm] | 5.0[mm] |
| CIRCUMFERENTIAL SPEED RATIO OF DEVELOPING ROLLER WITH RESPECT TO PHOTOSENSITIVE DRUM | 1.75 | × | × | × | × | × | × | × | ○ | ○ | ○ | △ | △ | △ | △ |
| | 1.60 | △ | △ | △ | △ | △ | × | × | ○ | ○ | ○ | ○ | ○ | △ | △ |
| | 1.45 | ○ | ○ | ○ | ◎ | ◎ | ○ | ○ | ○ | ○ | ○ | ◎ | ◎ | ◎ | ◎ |
| | 1.34 | ○ | ○ | ○ | ◎ | ◎ | ◎ | ◎ | ○ | ○ | ○ | ◎ | ◎ | ◎ | ◎ |
| | 1.24 | ○ | ○ | ○ | ○ | ○ | ○ | ○ | ○ | ○ | ○ | ○ | ○ | ○ | ○ |
| | 1.10 | ○ | ○ | ○ | ○ | ○ | ○ | ○ | ○ | ○ | ○ | ○ | ○ | ○ | ○ |
| | 1.05 | ■ | ■ | ■ | ■ | ■ | ■ | ■ | ■ | ■ | ■ | ■ | ■ | ■ | ■ |

FIG.14

| CIRCUMFERENTIAL SPEED OF PHOTOSENSITIVE DRUM | | 86[mm/s] | | | | | | | 191[mm/s] | | | | | | |
|---|---|---|---|---|---|---|---|---|---|---|---|---|---|---|---|
| THICKNESS OF ELASTIC LAYER | | 0.3[mm] | 0.5[mm] | 1.0[mm] | 2.0[mm] | 2.5[mm] | 3.0[mm] | 5.0[mm] | 0.3[mm] | 0.5[mm] | 1.0[mm] | 2.0[mm] | 2.5[mm] | 3.0[mm] | 5.0[mm] |
| TONER REMAINING RATE ON DEVELOPING ROLLER SURFACE | 45[%] | ■ | ■ | ■ | ■ | ■ | ■ | ■ | ■ | ■ | ■ | ■ | ■ | ■ | ■ |
| | 40[%] | ○ | ○ | ○ | ○ | ○ | ○ | ○ | ○ | ○ | ○ | ○ | ○ | ○ | ○ |
| | 30[%] | ○ | ○ | ○ | ◎ | ◎ | ○ | △ | ○ | ○ | ○ | ◎ | ◎ | ◎ | ○ |
| | 20[%] | ○ | ○ | ○ | ○ | ○ | △ | △ | ○ | ○ | ○ | ◎ | ◎ | ○ | ○ |
| | 5[%] | ○ | ○ | △ | △ | △ | × | × | ○ | ○ | ○ | ○ | ○ | △ | △ |
| | 0[%] | △ | × | × | × | × | × | × | ○ | ○ | ○ | △ | △ | × | × |

FIG.15

| CIRCUMFERENTIAL SPEED OF PHOTOSENSITIVE DRUM | | 86[mm/s] | | | | | | | 191[mm/s] | | | | | | |
|---|---|---|---|---|---|---|---|---|---|---|---|---|---|---|---|
| THICKNESS OF ELASTIC LAYER | | 0.3[mm] | 0.5[mm] | 1.0[mm] | 2.0[mm] | 2.5[mm] | 3.0[mm] | 5.0[mm] | 0.3[mm] | 0.5[mm] | 1.0[mm] | 2.0[mm] | 2.5[mm] | 3.0[mm] | 5.0[mm] |
| TONER REMAINING RATE ON DEVELOPING ROLLER SURFACE | 45[%] | ■ | ○ | ○ | ○ | ○ | ○ | ○ | ■ | ○ | ○ | ○ | ○ | ○ | ○ |
| | 40[%] | ■ | ○ | ○ | ○ | ○ | ○ | ○ | ■ | ○ | ○ | ○ | ○ | ○ | ○ |
| | 30[%] | ■ | ○ | ○ | ○ | ○ | ○ | ○ | ■ | ○ | ○ | ○ | ○ | ○ | ○ |
| | 20[%] | ■ | ○ | ○ | ○ | ○ | ○ | ○ | ■ | ○ | ○ | ○ | ○ | ○ | ○ |
| | 5[%] | ■ | ○ | ○ | ○ | ○ | ○ | ○ | ■ | ○ | ○ | ○ | ○ | ○ | ○ |
| | 0[%] | ■ | ○ | ○ | ○ | ○ | ○ | ○ | ■ | ○ | ○ | ○ | ○ | ○ | ○ |

IMAGE FORMING UNIT AND IMAGE FORMING APPARATUS

CROSS REFERENCE TO RELATED APPLICATIONS

This application claims priority benefits under 35 USC, section 119 on the basis of Japanese Patent Application No. 2014-084046, the disclosure of which is incorporated herein by reference.

BACKGROUND OF THE INVENTION

1. Field of the Invention

This invention relates to an image forming unit and an image forming apparatus and, more particularly, to those suitably applicable to such as, e.g., electrophotographic printers (hereinafter, referred to as printers).

2. Description of Related Art

Conventional printers are formed with a driven coupling for drum at the photosensitive drum, and with a driven coupling for roller at the developing roller. In such printers, an output shaft of a motor is coupled with a drive coupling for drum and a drive coupling for roller via plural gears attached to these couplings. The printer is structured to connect the drive coupling for drum with the driven coupling for drum, and to connect the drive coupling for roller with the driven coupling for roller while the surface of the developing roller is pushed to the surface of the photosensitive drum. With this mechanism, the printer transmits the rotation of the output shaft of the motor to the driven couplings for drum and roller via the drive couplings for drum and roller to rotate the photosensitive drum and the developing roller, and electrostatic latent images formed on the surface of the photosensitive drum are developed with toner transferred from the surface of the developing roller to form toner images onto the surface of the photosensitive drum (see, e.g., Japanese Application Publication (A1) No. 2009-116, 153).

With the conventional printer, however, the circumferential speed of the developing roller may be deviated periodically, so that irregular developments may occur on the electrostatic latent images on the surface of the photosensitive drum due to the toner, and there raises a problem that the image quality may be impaired upon occurrences of irregular pitches (hereinafter, referred to as jitters) at the printed images formed from toner images obtained through phenomena of the irregular developments.

In consideration for solving the above problem, it is therefore an object of the invention to provide an image forming unit and an image forming apparatus capable of preventing the quality of printing images from being degraded.

SUMMARY OF THE INVENTION

To solve the above problems, an image forming unit according to a first aspect of the invention comprises: an image carrier rotating by drive force transmitted via a first drive force transmission route and forming an electrostatic latent image on a surface thereof; and a developer carrier having an elastic layer carrying a developer on a surface thereof, rotating by drive force transmitted via a second drive force transmission route, and developing the electrostatic latent image with the developer. The electrostatic latent image is developed with the developer under a development condition that, where the elastic layer of the developer carrier is set to have a thickness in a range from 0.5 mm to 2.5 mm, the developer carrier is rotated with a circumferential speed ratio with respect to the image carrier in a range from 1.10 to 1.45, or a development condition that, where the elastic layer of the developer carrier is set to have a thickness in a range more than 2.5 mm but not more than 5.0 mm, the developer carrier is rotated with a circumferential speed ratio with respect to the image carrier in a range from 1.10 to 1.24.

An image forming unit according to a second aspect of the invention, comprises an image carrier rotating by drive force transmitted via a first drive force transmission route and forming an electrostatic latent image on a surface thereof; and a developer carrier having an elastic layer carrying a developer on a surface thereof, rotating by drive force transmitted via a second drive force transmission route, and developing the electrostatic latent image with the developer. The electrostatic latent image is developed with the developer under a development condition that, where the elastic layer of the developer carrier is set to have a thickness in a range from 0.5 mm to 5.0 mm, the developer is made remaining on the surface of the developer carrier with a developer remaining rate in a range from 20% to 40%, or a development condition that, where the elastic layer of the developer carrier is set to have a thickness in a range in a range from 0.5 mm to 2.5 mm, the developer is made remaining on the surface of the developer carrier with a developer remaining rate in a range equal to or more than 5% and less than 20%.

With the invention, the image forming unit and the image forming apparatus capable of suppressing deterioration of the image quality can be realized.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure:

FIGS. 8A, 8B are schematic views for illustrating measurement of resistance values of the first to seventh rollers, in which FIG. 8A is a schematic top view and in which FIG. 8B is a schematic side view;

FIG. 11 is a table showing evaluation results of the first printing image formed from a printing image formation examination;

FIG. 12 is a table showing evaluation results of the second printing image formed from the printing image formation examination;

FIG. 13 is another table showing evaluation results of the first printing image formed from a printing image formation examination;

FIG. 14 is yet another table showing evaluation results of the first printing image formed from the printing image formation examination;

FIG. 15 is another table showing evaluation results of the second printing image formed from the printing image formation examination;

DETAILED DESCRIPTION OF EMBODIMENTS

Selected embodiments of the present invention will now be explained with reference to the drawings. It will be apparent to those skilled in the art from this disclosure that the following descriptions of the embodiments of the invention are provided for illustration only and not for the purpose of limiting the invention as defined by the appended claims and their equivalents.

First Embodiment (i-1) Internal Structure of the Printer

Figure 1:
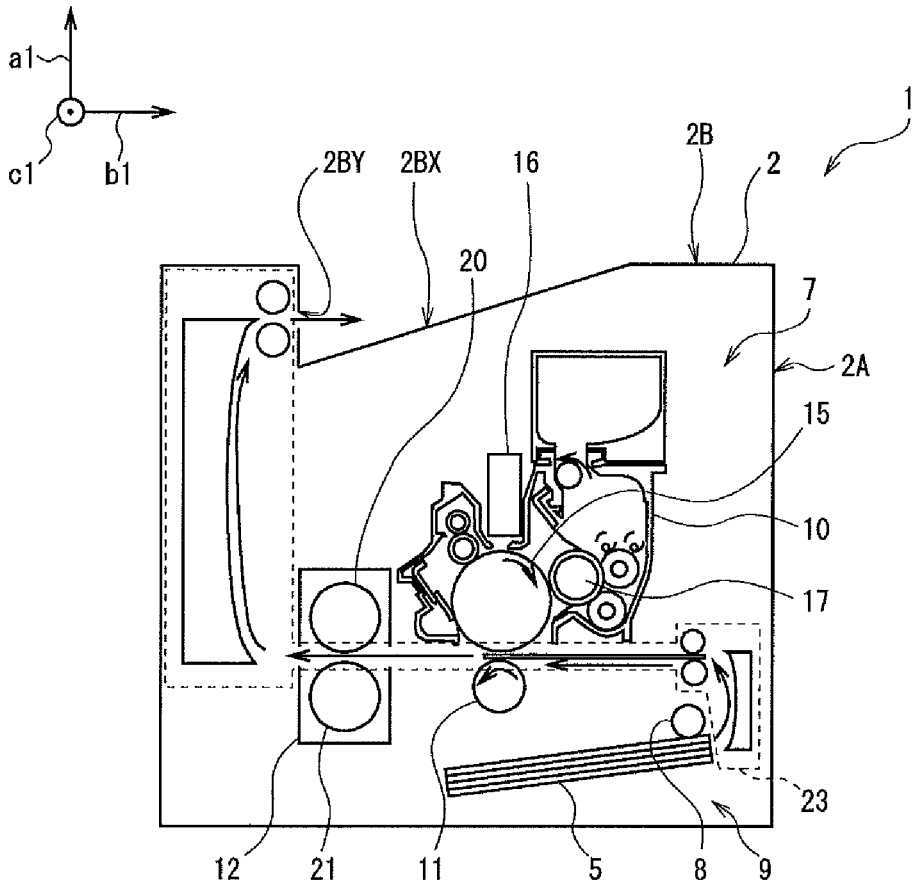
FIG. 1 is a schematic side view showing an internal structure of a printer according to the invention.
Figure 3:
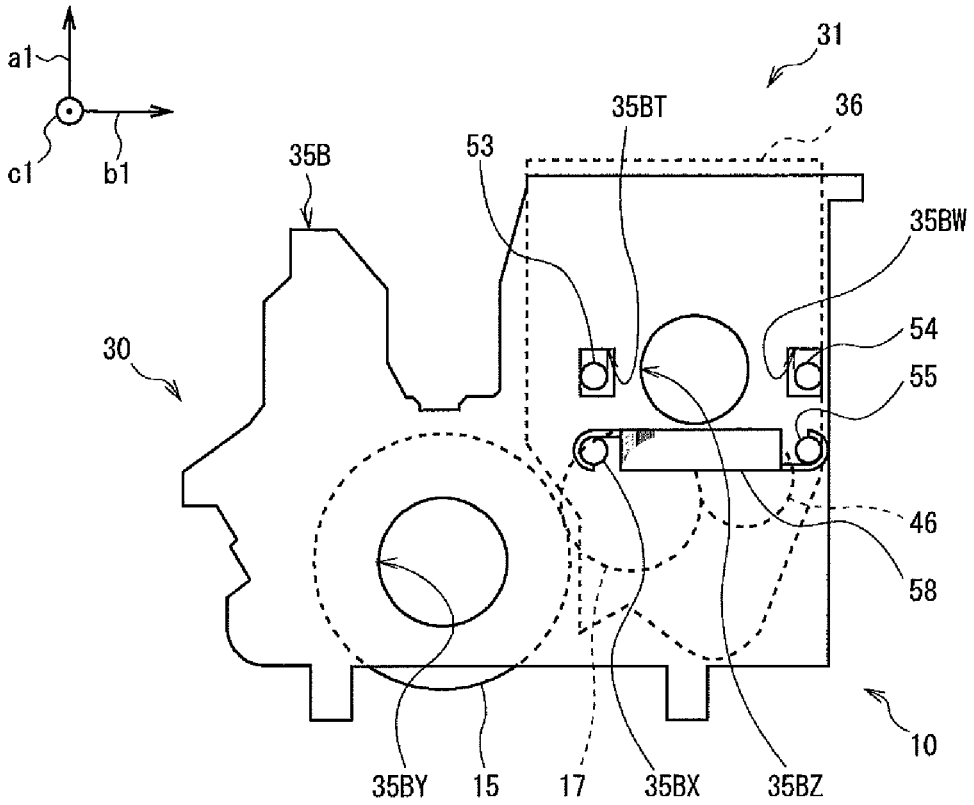
FIG. 3 is a schematic side view showing an attachment of a developing unit to a drum unit.

FIG. 1 shows a monochrome printer 1 of a direct transfer method according to the invention. The printer 1 has, e.g., a substantially box type housing 2 (hereinafter, referred to as a printer housing), whose front side 2A is shown on a right end in FIG. 1. In the described below, a direction shown with an arrow a1 in FIG. 1 when the printer 1 is viewed from the front side 2A of the printer housing 2, is referred as a printer up direction; a direction opposite to the direction is referred to as a printer down direction; where any distinction between them is not needed, the direction is referred to collectively as a printer up and down direction. In the described below, a direction shown with an arrow b1 in FIG. 1 when the printer 1 is viewed from the front side 2A of the printer housing 2, is referred as a printer front direction; a direction opposite to the direction is referred to as a printer back direction; where any distinction between them is not needed, the direction is referred to collectively as a printer back and forth direction. In the described below, a direction shown with an arrow c1 in FIG. 1 when the printer 1 is viewed from the front side 2A of the printer housing 2, is referred as a printer left direction; a direction opposite to the direction is referred to as a printer right direction; where any distinction between them is not needed, the direction is referred to collectively as a printer right and left direction. It is to be noted that a rotation direction shown with an arrow dl in FIG. 3 is referred to as one rotation direction, and a rotation direction opposite to this direction is referred to as the other rotation direction.

The printer housing 2 is formed with a medium tray portion 2BX for delivering printing media 5 on which printing images are formed, and a medium delivery opening 2BY is formed in a rear inner wall of the medium tray portion 2BX. On the other hand, in the printer housing 2, an image forming section 7 for forming printing images on the surface of the printing medium 6 is disposed at a center, and a medium supply section 9 having a medium cassette (not shown) capable of loading plural printing media 5 and a feeding roller 8 for feeding the printing media 5 from the medium cassette, is disposed at a lower end. The image forming section 7 includes an image forming unit 10, a transfer roller 11, and a fixing unit 12. The image forming unit 10 is detachably attached to the printer housing 2. The image forming unit 10 has, e.g., a photosensitive drum 15 serving as an image carrier, an LED (light emitting diode) head 16 serving as an exposure unit, and a developing roller 17 serving as a developing carrier carrying toner as a developer, forms electrostatic latent images by radiation of exposure light from the LED head 16 onto the surface of the photosensitive drum 15, and forms toner images as development images by developing the electrostatic latent images with the developing roller 17 using black toner. The transfer roller 11 transfers the toner images formed on the surface of the photosensitive drum 15, to the surface of the printing media 5. The fixing unit 12 includes, e.g., a heating roller 20 formed inside with a prescribed heat generator (not shown), and a pressure roller 21. The fixing unit 12 applies heat and pressure as nipping and conveying the printing media 5 having the surfaces to which the toner images are transferred, thereby melting and fixing the toner images on the surface of the printing media 5 to form the printing images. In the printer housing 2, a medium conveyance unit 23 is provided, and a medium conveyance route is formed of, such as, e.g., conveyance rollers of plural pairs, plural conveyance guides, and plural conveyance motors, for conveying the printing media 5 from the medium cassette to the medium delivery opening 2BY via the image forming section 7.

(i-2) Structure of the Image Forming Unit

Figure 2:
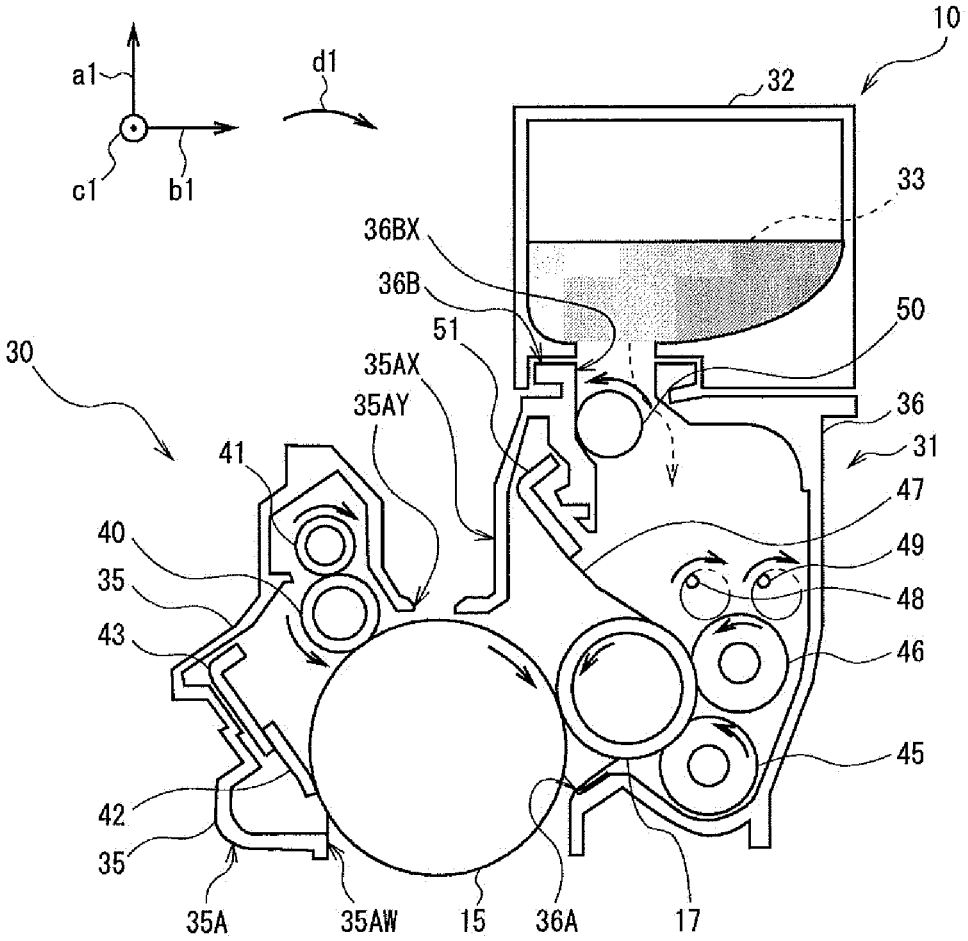
FIG. 2 is a schematic cross section showing a structure of an image forming unit.

As shown in FIG. 2, the image forming unit 10 is formed with a drum unit 30 serving as an image carrier unit having the photosensitive drum 15, a developing unit 31 serving as a developer carrier unit having the developing roller 17, and a toner cartridge 32 containing the toner 33 in black. The toner 33 is produced as, e.g., non-magnetic one-component negative charge type toner using styrene-acryl resin as a binder through an emulsion polymerization method. The drum unit 30 is jointed to each end of a drum container 35A in a substantially box shape extending in the printer right and left direction with a left side plate and a right side plate of the unit 30, and has a drum containing frame 35 formed in a substantially angular letter U shape as a whole. A drum exposure opening 35AW is formed at the drum container 35A, and the drum unit 30 is formed with a head insertion groove 35AX having a slit 35AY. The developing unit 31 has a roller containing frame 36 in a substantially box shape extending in the printer right and left direction; a roller exposure opening 36A is formed at the roller containing frame 36; the developing unit 31 is formed with a cartridge attachment 36B having a toner inlet 36BX in a projecting manner. The image forming unit 10 is structured to fit the roller containing frame 36 between front end plates of the left side plate and the right side plate of the drum containing frame 35, thereby making the developing unit 31 detachably attached to the drum unit 30. The developing unit 31 takes the toner 3 into the interior of the roller containing frame 36 from the toner cartridge 32 detachably attached to the unit via the cartridge attachment 36B. The drum containing frame 35 allows the exposure light to enter into the drum container 35A via the slit 35AY when the LED head 16 inserted into the head insertion groove 35AX emits the exposure light.

The drum unit 30 includes, in addition to the photosensitive drum 15, a charge roller 40 serving as a charge unit for charging the surface of the photosensitive drum 15 to form the electrostatic latent image, a cleaning roller 41 removing such as, e.g., the toner 33 attached to the surface of the charge roller 40 from the surface, a cleaning blade 42 removing the remaining toner 33 after the toner image is transferred from the surface of the photosensitive drum 15. The photosensitive drum 15 is formed as an organic photosensitive body serving as a photosensitive layer in which a charge generation layer and a charge transfer layer are accumulated sequentially on the entire outer peripheral surface of a conductive metal pipe, such as aluminum, that a drum body has a prescribed length, and shafts made of conductive metal are provided at each end of the drum body in a projecting manner. The surface of the drum body becomes the surface of the photosensitive drum 15 for forming electrostatic latent images. The photosensitive drum 15 exposes a part on a front side of the surface via the drum exposure opening 35AW, and is supported to the drum containing frame 35 via a pair of the shafts in a rotatable manner in the one-rotation direction.

The charge roller 40 is, for example, formed in which the entire outer peripheral surface of the center of the conductive metal shaft that the roller body has a prescribed length is covered with a semiconductive elastic layer having a prescribed substantially uniform thickness. The charge roller 40 renders its surface push the surface of the photosensitive drum 15 and is supported at the drum containing frame 35 in a rotatable manner in the other rotation direction via one and the other ends of the shaft. The cleaning roller 41 is, for example, formed so that an elastic layer covers the entire outer peripheral surface of the center of the metal shaft, and is supported at the drum containing frame 35 in a manner rotatable in rendering its surface pushing the charge roller 40. The cleaning blade 42 is formed in a substantially strip shape made of an elastic body such as, e.g., urethane rubber, epoxy rubber, acryl rubber, and is pushed toward the surface of the photosensitive drum 15 upon being secured to a blade supporter 43.

To the contrary, the developing unit 31 includes, in addition to the developing roller 17, first and second supply rollers 45, 46 serving as developer supply units supplying toner to the surface of the developing roller 17, and a toner blade 47 serving as a developer thickness limiting unit for limiting the toner thickness carried on the surface of the developing roller 17. The developing unit 31 includes, in the roller containing frame 36, first and second toner stirring bars 48, 49 for stirring the toner 33, and the toner stirring roller 50. The developing roller 17 is, for example, formed in which the entire outer peripheral surface of the center of the conductive metal shaft that the roller body has a prescribed length is covered with a semiconductive elastic layer having a prescribed substantially uniform thickness, and one end and the other end of the shaft are projected from the one end and the other end of the roller body. The developing roller 17 has a part on a rear side of the surface pushed to the surface of the photosensitive drum 15 via the roller exposure opening 36A, and is supported in a rotatable manner in the other rotation direction via the one end and the other end of the shaft by means of the roller containing frame 36.

The first supply roller 45 is, for example, formed in which the entire outer peripheral surface of the center of the conductive metal shaft that the roller body has a prescribed length is covered with a silicone rubber sponge having a prescribed substantially uniform thickness. The first supply roller 45 has a surface pushed to the surface of the developing roller 17, and is supported in a manner rotatable to the other direction by means of the roller containing frame 36. The toner blade 47 is formed in a stripe shape having a prescribed length made of, e.g., stainless steel. The toner blade 47 is secured to a blade supporter 51 in a way that a tip portion is pushed to a surface of the developing roller 17 on a downstream side of the second supply roller 46 in the rotation direction of the developing roller 17.

As shown in FIG. 3, the developing unit 31 is formed with a pair of posts 53, 54 on a left end surface of the roller containing frame 36, and another pair of posts, not shown, on a right end surface of the frame. The drum unit 30 holds the developing unit 31 horizontally by inserting the pair of the posts 53, 54 on the left side of the roller containing frame 36 and the pair of the posts on the right side into a pair of post insertion holes 35BT, 35BW formed in a left side plate 35B of the drum containing frame 35 and post insertion grooves, not shown, extending in the printer back and forth direction, formed in a right side plate, not shown. The drum unit 30 pushes the surface of the developing roller 17 with a certain pressure to the surface of the photosensitive drum 15 while rendering one compression coil spring 58 engage a spring engagement projection 35BX arranged in a projecting manner from the left side plate 35B of the drum containing frame 35 and an engagement projection 55 provided on the left end surface of the roller containing frame 36 as extending substantially parallel to the printer back and forth direction, and while rendering the other compression coil spring, not shown, engage a spring engagement projection, not shown, arranged in a projecting manner from the right side plate of the drum containing frame 35 and an engagement projection, not shown, provided on the right end surface of the roller containing frame 36 as extending substantially parallel to the printer back and forth direction.

Figure 4:
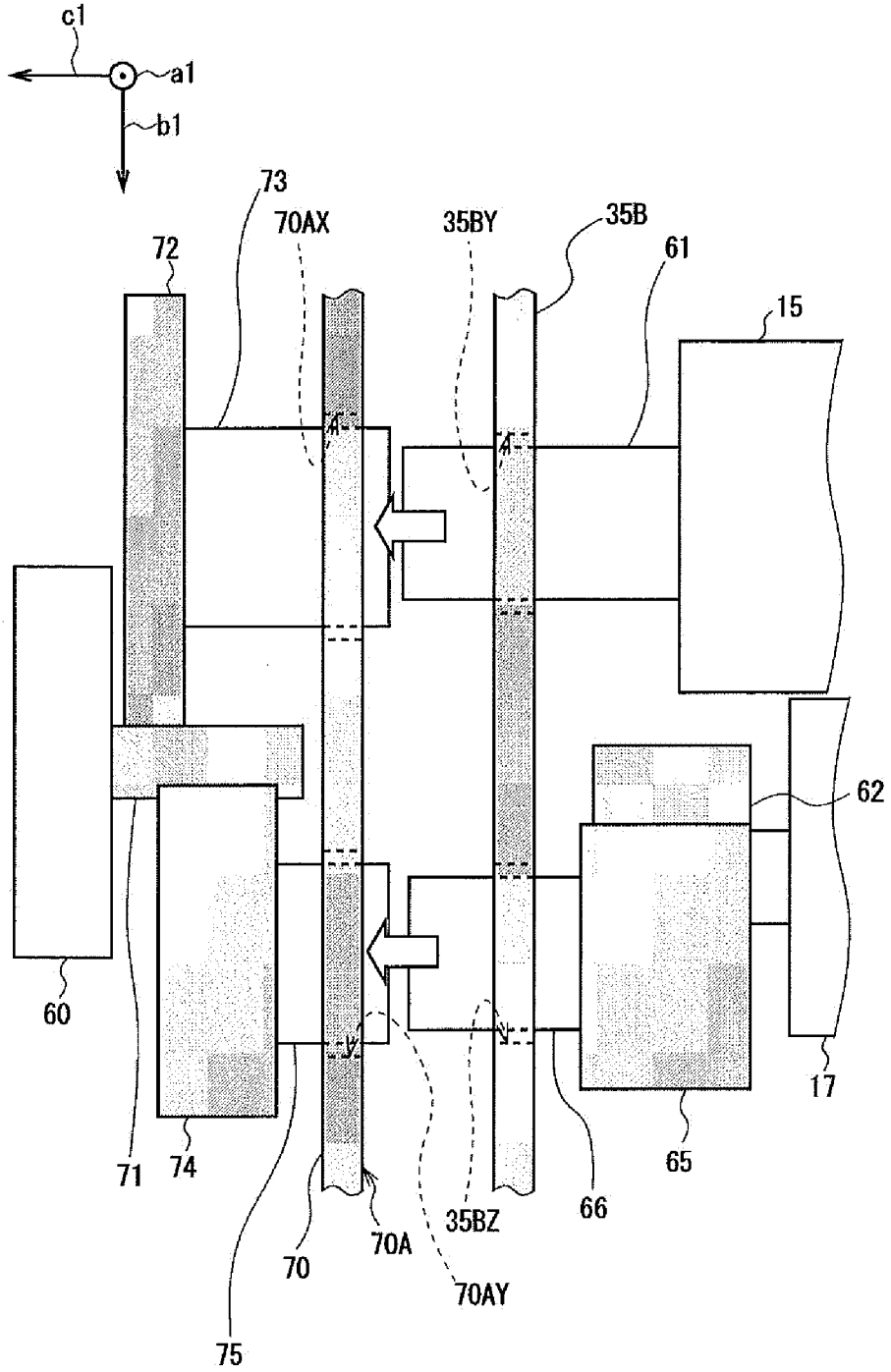
FIG. 4 is a schematic top view showing connections between a unit drive motor and the image forming unit.
Figure 5:
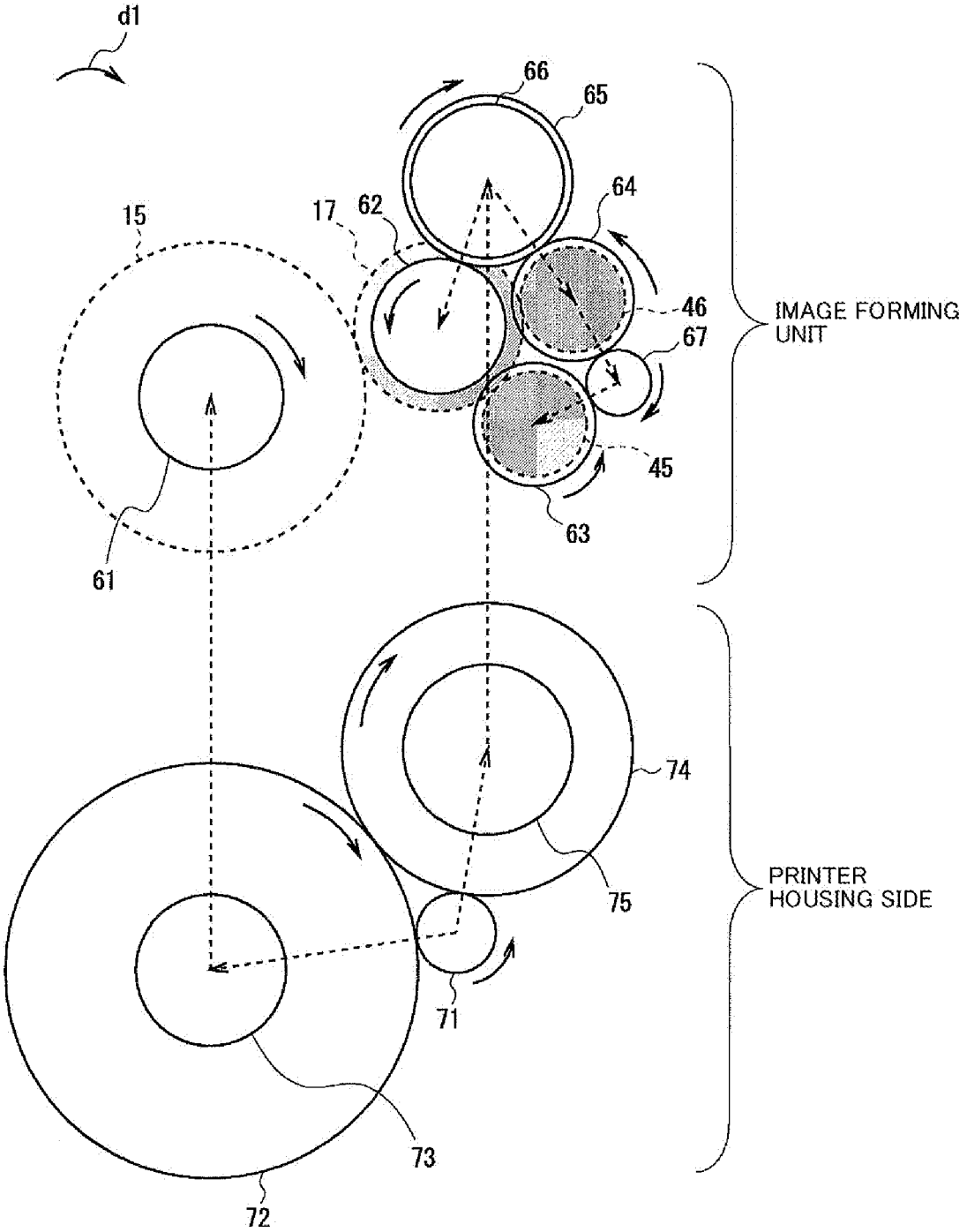
FIG. 5 is an illustration showing transmission of drive force from the unit drive motor to the image forming unit.

As shown in FIGS. 4, 5, in the drum unit 30, a drum coupling 61 is attached to, e.g., one shaft of the photosensitive drum 15 for obtaining drive force from a unit drive motor for the image forming unit 10, and a tip portion thereof is projected to the exterior from a drum coupling insertion hole 35BY of the left side plate 35B of the drum containing frame 35. In the developing unit 31, one end of the shaft of the developing roller 17 is positioned between the left side plate of the roller containing frame 36 and the left side plate 35B of the drum containing frame 35, thereby securing a developing roller gear 62. In the developing unit 31, one ends of the respective shafts of the first and second supply rollers 45, 46 are also positioned between the left side plate of the roller containing frame 36 and the left side plate 35B of the drum containing frame 35, thereby securing a first supply roller gear 63 and a second supply roller gear 64. With the developing unit 31, a developing unit coupling 66 is attached to a tip portion of a coupling shaft for obtaining drive force from a unit drive motor 60, and a tip portion of the coupling 66 is projected to the exterior from the developing coupling insertion hole 35BZ of the left side plate 35B of the drum containing frame 35. In the developing unit 31, a gear shaft, not shown, is supported rotatably in the one rotation direction near the first supply roller gear 63 and the second supply roller gear 64 at the left side plate of the roller containing frame 36, and an intermediate gear 67 secured to the gear shaft is meshed with the first supply roller gear 63 and the second supply roller gear 64.

On the other hand, in the printer housing 2, for example, a coupling holding casing 70 is disposed at a position facing the left end of the image forming unit 10; the unit drive motor 60 is disposed on the left side; a motor gear 71 is secured to an output shaft of the unit drive motor 60. The coupling holding casing 70 supports rotatably a drum side shaft and a development side shaft, not shown, in the one rotation direction, respectively, and a drum side coupling gear 72 and a development side coupling gear 74 secured to base portions of the shafts are made in mesh with the motor gear 71. The drum side shaft has a tip portion attaching to the drum side coupling 73, and the tip portion is projected to the exterior from a drum side coupling insertion hole 70AX of a right wall portion 70A of the coupling holding casing 70. The development side shaft has a tip portion attaching to the development side coupling 75, and the tip portion is projected to the exterior from a development side coupling insertion hole 70AY of the right wall portion 70A of the coupling holding casing 70.

Accordingly, where the image forming unit 10 is attached to the printer housing 2, the drum coupling 61 is coupled to the drum side coupling, whereas the developing unit coupling 66 is coupled to the development side coupling 75. With this coupling, in the printer housing 2, a first drive force transmission route is formed for transmitting the drive force of the unit drive motor 60 to the photosensitive drum 15, from the drum side coupling gear 72, the drum side coupling 73, and the drum coupling 61. In the printer housing 2, a second drive force transmission route is formed for transmitting the drive force of the unit drive motor 60 to the developing roller 17, from the development side coupling gear 74, the development side coupling 75, the development coupling 66, and the development roller gear 62. The second drive force transmission route is branched so that the drive force from the coupling gear 65 is made transmittable to the first supply roller 45 and the second supply roller 46 sequentially via the second supply roller gear 64, the intermediate gear 67, and the first supply roller gear 63. The image forming unit 10 thus renders the photosensitive drum 15 rotate in the one rotation direction according to the drive force transmitted via the first drive force transmission route where the single unit drive motor 60 operates to rotate the output shaft in, e.g., the other rotation direction, and renders the developing roller 17, and the first and second supply rollers 45, 46 rotate in the other rotation direction according to the drive force transmitted via the second drive force transmission route. The image forming unit 10 can rotate the charge roller 40 in the other rotation direction in association with the rotation of the photosensitive drum 15 when the photosensitive drum 15 rotates in the one rotation direction, because the charge roller 40 is pressed to the surface of the photosensitive drum 15. The image forming unit 10 can rotate the cleaning roller 41 in the one rotation direction in association with the rotation of the charge roller 40 when the charge roller 40 rotates in the other rotation direction because the one end of the shaft of the charge roller 40 and the one end of the shaft of the cleaning roller 41 are connected via a gear or gears.

The charge roller 40 is electrically connected to a charge roller power supply described below at, e.g., the shaft, and is applied at a direct current voltage of a prescribed voltage during formation of the printing images. With this structure, the image forming unit 10 can charge the surface of the photosensitive drum 15 at a prescribed charge potential for forming electrostatic latent images with the charge roller 40 as rotating the photosensitive drum 15 in the one rotation direction according to the operation of the unit drive motor 60. The image forming unit 10 can form the electrostatic latent images by exposing charged portions on the surface of the photosensitive drum 15 with the exposure light emitted from the LED head 16 when the charged portion of the surface reaches a portion facing the LED head 16 where the photosensitive drum 15 rotates in the one rotation direction. The developing roller 17 has, e.g., the shaft electrically connected to a developing roller power supply described below, and the first and second supply rollers 45, 46 have, e.g., the shafts electrically connected to a supply roller power supply described below, so that direct current voltages of respectively corresponding prescribed voltages are applied at a time of formation of the printing images. The toner blade 47 is electrically connected to a blade power supply described below, and a direct current voltage of a prescribed voltage value is applied during the formation of the printing images.

In addition to those, the image forming unit 10 properly chooses, e.g., a gear ratio between the motor gear 71 and the drum side coupling gear 72 so as to rotate the photosensitive drum 15 in the one rotation direction at a prescribed circumferential speed according to operation of the unit drive motor 60. The image forming unit 10 properly chooses, e.g., a gear ratio between the motor gear 71 and the developing roller gear 62 so as to rotate the developing roller 17 in the other rotation direction at a prescribed circumferential speed faster than the circumferential speed of the photosensitive drum 15 according to operation of the unit drive motor 60. During formation of the printing images, the image forming unit 10 therefore makes the surface of the developing roller 17 slide with respect to the surface of the photosensitive drum 15 where the photosensitive drum 15 rotates in the one rotation direction whereas the developing roller 17 rotates in the other rotation direction, according to the operation of the unit drive motor 60. The image forming unit 10 properly chooses, e.g., a gear ratio between the motor gear 71 and the second supply roller gear 64 so as to rotate the second supply roller 46 in the other rotation direction at a prescribed circumferential speed slower than the circumferential speed of the developing roller 17 according to operation of the unit drive motor 60. The image forming unit 10 properly chooses, e.g., a gear ratio between the motor gear 71 and the first supply roller gear 63 so as to rotate the first supply roller 45 in the other rotation direction at a prescribed circumferential speed slower than the circumferential speed of the developing roller 17 according to operation of the unit drive motor 60. The image forming unit 10 therefore makes the surface of the developing roller 17 slide with respect to the surfaces of the first and second supply rollers 45, 46 where the first and second supply rollers 45, 46, and the developing roller 17 as well rotate in the other rotation direction according to the operation of the unit drive motor 60. The image forming unit 10 therefore makes the surface of the developing roller 17 slide with respect to the tip portion of the toner blade 47 where the developing roller 17 rotates in the other rotation direction according to operation of the unit drive motor 60, because the tip portion of the toner blade 47 is pushed to the surface of the developing roller 17 as described above.

With the structure thus described, where the developing roller 17 rotates in the other rotation direction and where the first and second supply rollers 45, 46 rotate in the other rotation direction, the image forming unit 10 carries the toner 33 in cells on the surfaces of the first and second supply rollers 45, 46 and moves the toner 33 toward the developing roller 17. Where the toner 33 on the surface of the first and second supply rollers 45, 46 enters into a gap to the surface of the developing roller 17, the image forming unit 10 negatively charges the toner 33 from triboelectricity occurring on those surfaces and injection of charges, thereby supplying the toner 33 from the surfaces of the first and second supply rollers 45, 46 to be carried at the surface of the developing roller 17 according to the potential difference from the surface potential of the developing roller 17. Where the toner 33 on the surface of the developing roller 17 enters into a gap to the tip portion of the toner blade 47, the image forming unit 10 can negatively charge the toner 33 from triboelectricity occurring on those surfaces and injection of charges at that gap. At that time, the image forming unit 10 can limit the thickness of the toner 33 by removing excessive toner 33 equal to or more than a prescribed thickness from the surface of the developing roller 17 with the toner blade 47 even where the toner 33 equal to or more than the prescribed thickness is supplied from the surfaces of the first and second supply rollers 45, 46 to the surface of the developing roller 17.

Where the toner 33 on the surface of the developing roller 17 enters into a gap to the surface of the photosensitive drum 15, the image forming unit 10 can negatively charge the toner 33 from triboelectricity occurring on the surface and injection of charges at that gap. At that time, if the exposure portion on the surface of the photosensitive drum 15 reaches the pressed portion (hereinafter, referred to as roller pressed portion) of the surface of the developing roller 17, the image forming unit 10 makes the toner 33 transferred from the surface of the developing roller 17 and attached to electrostatic latent images on the surface of the photosensitive drum 15, according to the potential difference between the potential of the electrostatic latent images on the surface of the photosensitive drum 15 and the potential of the toner 33 on the surface of the developing roller 17, as well as frictional force occurring between the surface of the developing roller 17 and the surface of the photosensitive drum 15. The image forming unit 10 thus can form toner images by developing the electrostatic latent images on the surface of the photosensitive drum 15 with the toner 33. It is to be noted that the transfer roller 11 described above has a shaft electrically connected to a transfer roller power supply described below, and is applied at a direct current voltage of a prescribed voltage value during formation of the printing images. The transfer roller 11 has the surface pressed to the surface of the photosensitive drum 15. During formation of the printing images, the transfer roller 11 sandwiches the printing media 5 between itself and the photosensitive drum 15 to convey the printing media 5, and can transfer the toner images from the surface of the photosensitive drum 15 to the surface of the printing media 5.

(i-3) Circuit Structure of the Printer

Figure 6:
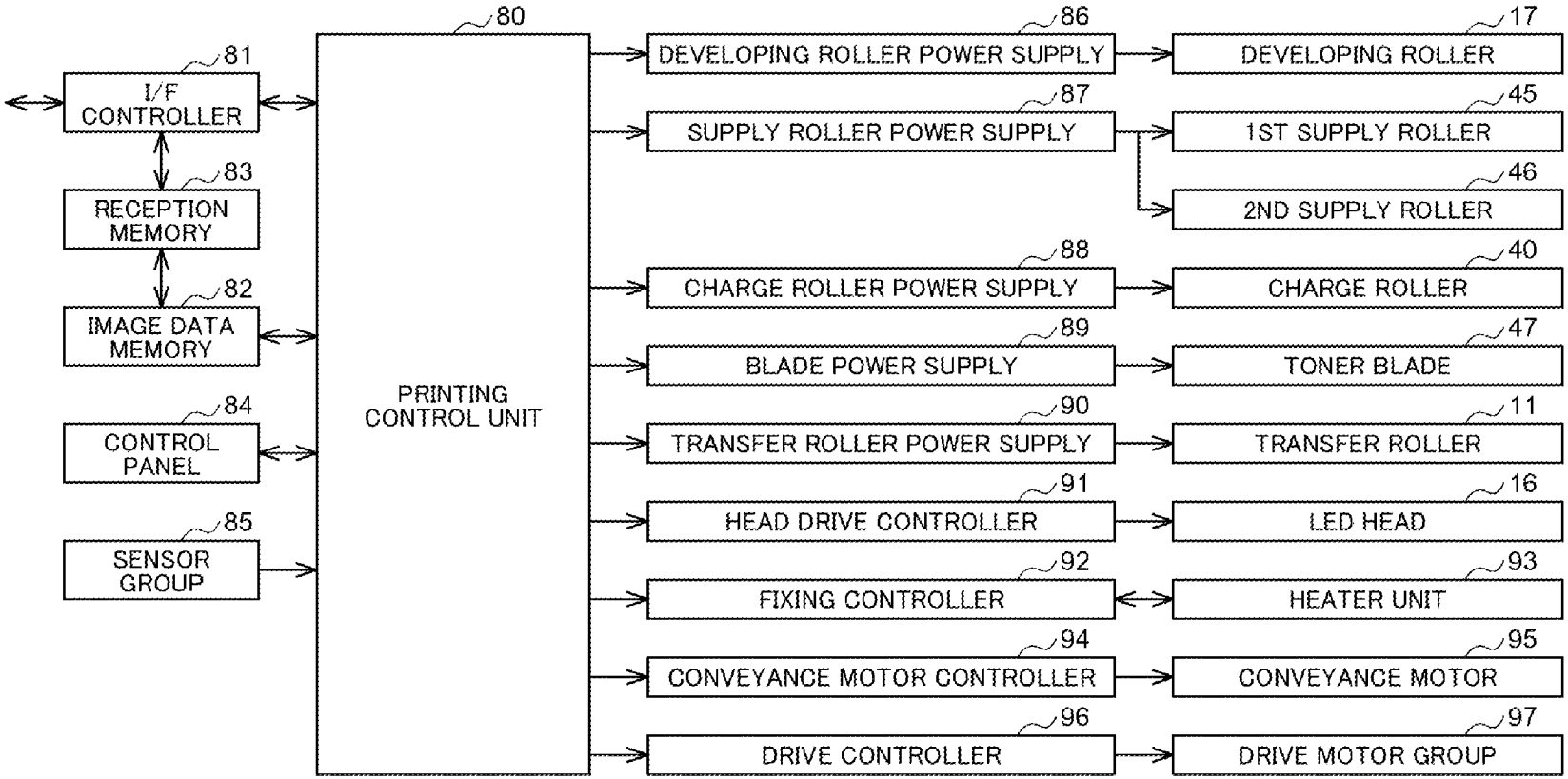
FIG. 6 is a block diagram showing a circuit structure of the printer.

As shown in FIG. 6, the printer 1 has a printing control unit 80 of, e.g., a microprocessor structure for controlling the entire printer 1 for forming printing images. The printing control unit 80 is connected to a control panel 84 provided at the printer housing 2 and to a sensor group 85 for detecting such as operation circumstance and operation status of the printer 1. The printing control unit 80 is connected to the LED head 16 via a head drive controller 91, and is connected to a heater unit 93 having a heat generator of the fixing unit 12 and a temperature sensor or sensors via a fixing controller 92. The printing control unit 80 is connected to a conveyance motor 95 via a conveyance motor controller 94, and to the unit drive motor 60 via the drive controller 96, a fixing unit drive motor not shown for driving the fixing unit 12, and a feed drive motor not shown for driving the feeding roller 8, as a drive motor group.

In the printing control unit 80, printing data transmitted from a host apparatus are received at an interface controller 81 and stored in an image data memory 82 via the reception memory 83, and if printing of printing target images is instructed via the interface controller 81 from the host apparatus, the drive controller 96 activates the fixing unit drive motor to rotate the heating roller 20 and the pressure roller 21 in the fixing unit 12, and the fixing controller 92 controls the heater unit 93 to heat the heating roller 20 up to a prescribed temperature. The printing control unit 80 rotates the photosensitive drum 15, the developing roller 17, the first supply roller 45, and the second supply roller 46 in the image forming unit 10 upon operation of the unit drive motor 60 from the drive controller 96. In addition, the printing control unit 80 applies direct current voltages of respectively corresponding prescribed voltage values to the developing roller 17, the first and second supply rollers 45, 46, the charge roller 40, the toner blade 47, the transfer roller 11 from a developing roller power supply 86, a supply roller power supply 87, a charge roller power supply 88, a blade power supply 89, and a transfer roller power supply 90. The printing control unit 80 reads out printing data from the image data memory 82, produces image data for controlling the LED head 16, and stores the data in the image data memory 82.

In this state, the printing control unit 80 activate the conveyance motor 95 via the conveyance motor controller 94, and conveys the printing media 5 to the image forming section 7 via the medium conveyance route upon feeding the printing media 5 sheet by sheet from the medium cassette with the feeding roller 8 by operation of the feeding motor with the drive controller 96. At that time, the printing control unit 80 reads out the image data from the image data memory 82 and controls the data upon sending the data to the LED head 16 via the head drive controller 91. With this operation, while emitting the exposure light from the LED head 16 to the surface of the photosensitive drum 15 to form electrostatic latent images in the image forming unit 10, the printing control unit 80 forms toner images by developing the electrostatic latent images with the toner 33 by means of the developing roller 17. After transferring the toner images on the surface of the photosensitive drum 15 to the surface of the printing media 5 as conveying the printing media 5 conveyed via the medium conveyance route while nipping the printing media 5 between the photosensitive drum 15 and the transfer roller 11, the printing control unit 80 delivers the printing media 5 to the medium tray portion 2BX upon conveying the media to the medium delivery opening 2BY via the medium conveyance route after forming printing images upon fixing the toner images on the surface of the printing media 5 in the fixing unit 12.

(i-4) Printing Image Formation Text

In the printer 1, the drum body of the photosensitive drum 15 has a hardness higher than the roller body of the developing roller 17. The surface of the developing roller 17 is pressed to the surface of the photosensitive drum 15; the photosensitive drum 15 is rotated in the one rotation direction at a prescribed circumferential speed; the developing roller 17 is rotated in the other rotation direction at a prescribed circumferential speed faster than the circumferential speed of the photosensitive drum 15. Because the drum body of the photosensitive drum 15 is harder than the roller body of the developing roller 17, pressing tension force in the reverse direction to the rotation direction of the developing roller 17 exerts to the roller pressing portion from the photosensitive drum 15, and returning force for making the shape back to the rotation direction of the developing roller 17 exerts when departing from the surface of the photosensitive drum 15. In the printer 1, it is through that if the circumferential speed of the developing roller 17 is deviated due to backlashes between the coupling gear 65 and the developing roller gear 62, the pressing tension force and the returning force exerting to the roller pressing portion are fluctuated, so that the elastic layer may be vibrated due to fluctuations of such the pressing tension force and the returning force. With this printer 1, it is thought that such vibration of the elastic layer of the developing roller 17 may cause development irregularity on the surface of the photosensitive drum during development of the electrostatic latent images, and jitters may occur in the printing images due to the development irregularity. The development irregularity occurring on the surface of the photosensitive drum 15 means irregular attachment of the toner 33 such that the amount of the toner 33 attached to the electrostatic latent images on the surface of the photosensitive drum 15 becomes larger than a proper amount for development only at portions in stripe along the longitudinal direction of the drum with, e.g., almost a pitch interval of the developing roller gear 62 along the circumferential direction of the drum. Jitters occurring in the printing images are irregularity of color density that a color pattern of stripes shape denser that a normal state along the main scanning direction appears with, e.g., almost a pitch interval of the developing roller gear 62 along a sub-scanning direction on the printing images.

Figure 7:
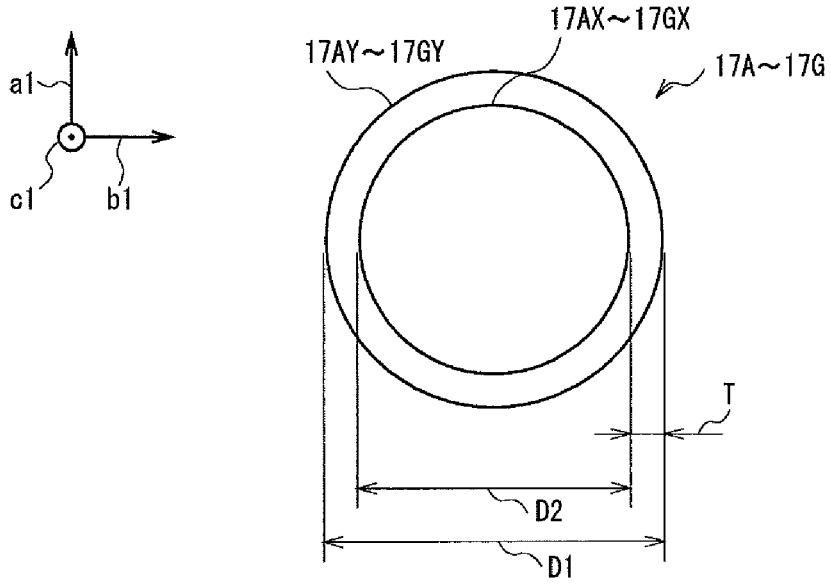
FIG. 7 is a schematic side view showing a structure of first to seventh rollers.

With the first embodiment, the printer 1 describe above was used to form the toner images by developing the electrostatic latent images under various development conditions with the image forming unit 10; a printing image formation test for forming the printing images on the surface of the printing media 5 based on the toner images was performed; existence of jitter occurrence to the printing images was checked, and image quality was evaluated. Hereinafter, the printing image formation test, and evaluation results of the printing images are described. In the printing image formation test, used was the toner 33 having a volume mean particle size of around 6.8 micron meters measured in use of Coulter Multisizer (product name) made by Beckman Coulter and having a roundness of 0.97 measured in use of flow type particle image analyzer FPIA-3000 by made by Sysmex Corp. As shown in FIG. 7, during the printing image formation test, first to seventh developing rollers 17A to 17G were used in which the roller body was formed having, e.g., an outer diameter D1 of about 22 mm with changing outer diameters D2 of the respective shafts 17AX to 17GX and changing thicknesses T of the respective elastic layers 17AY to 17GY. The thicknesses T of the elastic layers 17AY to 17GY of the first to seventh developing rollers 17A to 17G were set approximately to 0.3 mm, 0.5 mm, 1.0 mm, 2.0 mm, 2.5 mm, 3.0 mm, 5.0 mm. The developing roller 17 is generally set to having the thickness of the elastic layer of about 5.0 mm. In this printing image formation test, therefore, the upper limitation of the thicknesses T of the elastic layers 17AY to 17GY was set to about 5.0 mm.

Figure 8A:
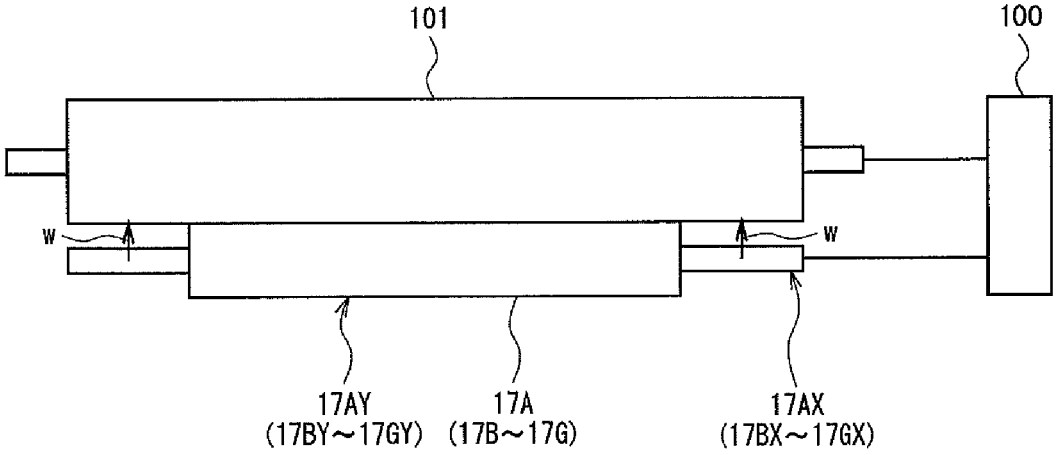
Figure 8B:
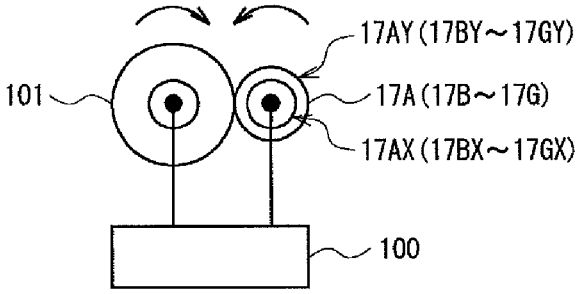

Although the elastic layers 17AY to 17GY of the first to seventh developing rollers 17A to 17G were producible from various rubber materials such as, e.g., silicone rubber and urethane rubber as a base material, the elastic layers 17AY to 17GY were produced from, e.g., a urethane rubber as a base material. More specifically, the elastic layers 17AY to 17GY were produced as a semi-conductive urethane rubber having a properly adjusted electric resistance by adding carbon blacks such as acetylene black, Ketjenblack as conductive agents where the polyether based polyol and aliphatic isocyanate were used as the base polymer. The elastic layers 17AY to 17GY were finished with an isocyanate treatment using an isocyanate treatment liquid to the surfaces, and after the isocyanate treatment liquid is dried out, where the surfaces were wiped with fabrics dipped in an isopropyl alcohol as an organic solvent, the charge property of the respective surfaces was improved to be approximately uniform, so that the surfaces were made to carry the toner 33 properly. The isocyanate treatment liquid was produced, after isocyanate compound such as diphenylmethane isocyanate, paraphenylene isocyanate, and tolylene diisocyanate was solved in an organic solvent such as ethyl acetate, by adding carbon blacks such as acetylene black, Ketjenblack to the organic solvent. The first to seventh developing rollers 17A to 17G had the resistance value of $1\times10^5$ ohms measured in use of High-Resistance Meter No. 4339B made of Hewlett Packard Company, and was generally suitable in a range between $1\times10^4$ ohms and $1\times10^8$ ohms. As shown in FIG. 8A, 8B, the resistance values of the first to seventh developing rollers 17A to 17G were obtained as mean values of the resistance values measured at one hundred (100) points per one round, where a load of W=500 grams was exerted to each end of the shafts 17AX to 17GX where the surfaces of the elastic layers 17AY to 17GY were made in contact with the surface of a metal roller 101 of an SUS material having a diameter of 30 mm, and where a direct current voltage of −100 volts was applied to the shafts 17AY to 17GY through the High-Resistance Meter 100.

In the printing image formation test, the toner blade 47 having a plate thickness of around 0.08 mm and a tip portion fabricated with a bending process for radius curvature of about 0.35 mm was used, and the tip portion was pressed with a linear load of about 40 gf/cm to the surface of the first to seventh developing rollers 17A to 17G. In the printing image formation test, regarding a setting condition of the toner blade 47, to make the thickness and the charge amount of the toner 33 on the first to seventh developing rollers 17A to 17G desirable values, the surface roughness and resistance values of the elastic layers 17AY to 17GY were reviewed, and the ten-point mean roughness Rz of the surface (JIS B0601-1994) was set to, e.g., 5 micron meters because it is proper to set the range between 2 micron meters to 10 micron meters. The ten-point mean roughness Rz of the surface of the elastic layers 17AY to 17GY were measured in use of Surf Coder SEF3500 made of Kosaka Laboratory Ltd, with a stylus radius of 2 microns, a stylus pressure of 0.7 mN, and a feed speed of the stylus of 0.1 mm/sec. In the printing image formation test, the photosensitive drum 15 whose drum body had an outer diameter of around 40 mm was used, and the surface of the photosensitive drum 15 was made to encroach around 0.06 mm on the surfaces of the first to seventh developing rollers 17A to 17G by urging the first to seventh developing rollers 17A to 17G with the pair of contraction springs 58 described above having the load of around 700 gf.

In the printing image formation test, the first supply roller 45 and the second supply roller 46 were used which were produced, after an unvulcanized silicone rubber compound was molded with a method such as an extrusion, by heating and foamed-vulcanizing the silicone rubber sponge of the roller body. The silicone rubber compound was produced from various raw rubbers such as dimethyl silicone raw rubber, methyl phenyl silicone raw rubber by adding an inorganic foaming agent or agents such as, e.g., reinforcing silica filler, vulcanizer needed for vulcanized hardening, sodium bicarbonate as a foaming agent, or an organic foaming agent such as azodicarbonamide (ADCA). The first supply roller 45 and the second supply roller 46 may have a semi-conductive property by adding such as, e.g., carbon blacks such as acetylene black, Ketjenblack to the silicone rubber sponge. The first supply roller 45 and the second supply roller 46 can adjust Asker F hardness of the silicone rubber sponge by adjusting an addition amount of the vulcanizer to the silicone rubber compound. Because those silicone rubber sponges had a diameter of the cells of, e.g., about 200 microns to 500 microns, and because a suitable range of Asker F hardness was from 30 degrees to 70 degrees approximately, the rubber thickness was set to about, e.g., 4 mm, and Asker F hardness was 63 degrees. The first supply roller 45 and the second supply roller 46 had a measured value $1\times10^5$ ohms measured in use of the High-Resistance Meter 100 in the same manner described above, by exerting the load of 200 g to each end of the shaft and by applying a direct current voltage of −300 volts, and was in a generally suitable range between $1\times10^4$ ohms and $1\times10^8$ ohms. In the printing image formation test, the first supply roller 45 and the second supply roller 46 in the image forming unit 10 were disposed so that the surfaces of the rollers 45, 46 encroached about 0.7 mm on the surfaces of the first to seventh developing rollers 17A to 17G.

The printer 1 is structured to rotate the photosensitive drum 15 selectively with, e.g., either one of two kinds circumferential speeds, a first drum circumferential speed of around 86 mm/sec and a second drum circumferential speed of around 191 mm/section according to the kind of the printing media 5. Accordingly, in this printing image formation test, the circumferential speed of the photosensitive drum 15 was set to the two kinds, the first drum circumferential speed and the second drum circumferential speed. In this printing image formation test, where the photosensitive drum 15 was rotated with the first drum circumferential speed, as changing the development condition, the first to seventh developing rollers 17A to 17G were used in this sequence. In the printing image formation test, where the first to seventh developing rollers 17A to 17G were used, the developing roller 62 was sequentially replaced to change the gear ratio between the motor gear 71 and the developing roller gear 62, thereby rotating the first to seventh developing rollers 17A to 17G with the first to sixth roller circumferential speeds as the first to sixth circumferential speed ratios to the first drum circumferential speed of the photosensitive drum 15. The first to sixth circumferential speed ratios were around 1.05, 1.10, 1.24, 1.34, 1.45, and 1.60.

In the printing image formation test, where the photosensitive drum 15 was rotated with the second drum circumferential speed, the first to seventh developing rollers 17A to 17G were used sequentially to change the development condition, and the first to seventh developing rollers 17A to 17G were rotated with tenth to fifteenth roller circumferential speeds as the first to sixth circumferential speed ratios to the second drum circumferential speed of the photosensitive drum 15. In the printing image formation test, where the first to seventh developing rollers 17A to 17G were rotated with any of the first to sixth roller circumferential speeds and the tenth to fifteenth roller circumferential speeds, the first supply roller gear 63 and the second supply roller gear 64 were properly replaced to change the gear ratio to the developing roller gear 62, thereby rotating the first supply roller 45 and the second supply roller 46 in the other rotation direction with the circumferential speed of a circumferential speed ratio of around 0.96 to the first to seventh developing rollers 17A to 17G. In the printing image formation test, even where any of the first to seventh developing rollers 17A to 17G was used, the developing roller power supply 86 applied a direct current voltage of around −200 volts to the first to seventh developing rollers 17A to 17G; the supply roller power supply 87 applied a direct current voltage of around −300 volts to each of the first supply roller 45 and the second supply roller 46; the blade power supply 89 applied a direct current voltage of around −300 volts to the toner blade 47. Under those conditions, the toner 33 carried on the surface of the first to seventh developing rollers 17A to 17G had the toner weight per unit area from around 0.45 mg/cm$^2$ to around 0.62 mg/cm$^2$ as in a state that the toner blade 47 limited the thickness.

Figure 9:
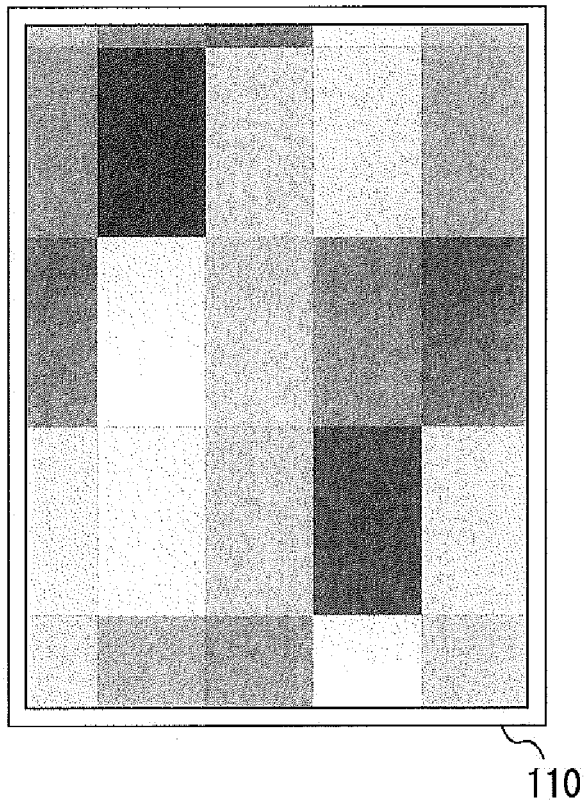
FIG. 9 is an illustration showing a structure of a first printing image.
Figure 10:
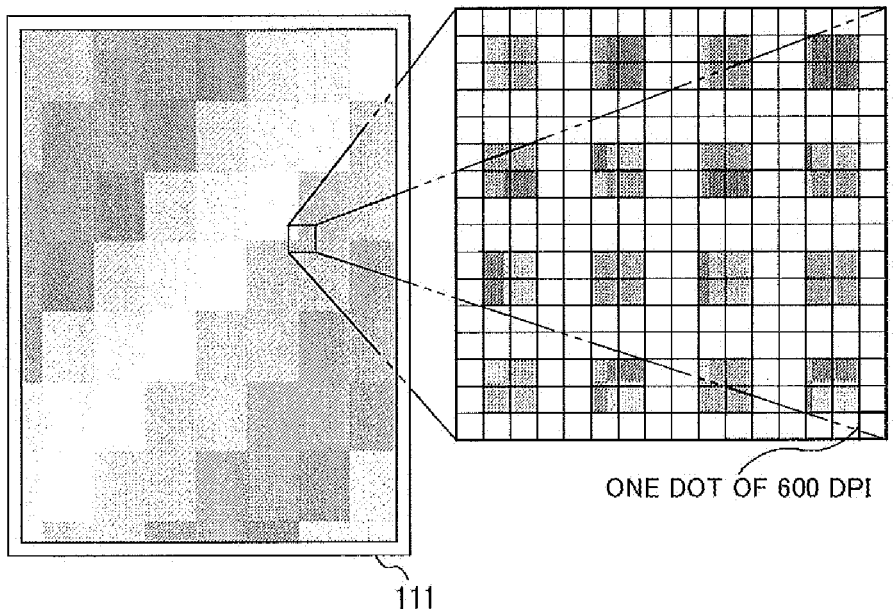
FIG. 10 is an illustration showing a structure of a second printing image.

In the printing image formation test, the printer 1 was set so that the photosensitive drum 15 rotated with the first drum circumferential speed or the second drum circumferential speed, to form a first printing image 110 as a solid image as shown in FIG. 9 on the surface of the printing medium 5 at each of settings that the first to seventh developing rollers 17A to 17G were used sequentially to rotate at the first to sixth circumferential speed ratios. The first printing image 110 was formed upon fixing the toner 33 at the entire dots of, e.g., 600 dpi resolution. In the printing image formation test, the printer 1 was set so that the photosensitive drum 15 rotates at the first drum circumferential speed or the second drum circumferential speed, and a second printing image 111 as a two-by-two image shown in FIG. 10 on the surface of the printing media 5 was formed at each of settings that the first to seventh developing rollers 17A to 17G were used sequentially to rotate at the first to sixth circumferential speed ratios. The second printing image 111 was formed with a pattern fixing the toner 33 at the positions of two dots by two dots of the two-dot interval with, e.g., 600 dpi resolution in the main and sub scanning directions.

In the printing image formation test, the formation states of the first printing image 110 and the second printing image 111 formed on the surface of the printing media 5 were evaluated by naked eyes as well as by confirming image densities measured in use of X-rite 528 SpectroDensitomete (product name) made by X-rite, Incorporated. The evaluated results are described in referring to FIG. 11 and FIG. 12. In FIG. 11 and FIG. 12, development conditions as various combinations of the thicknesses T of the elastic layers 17AY to 17GY of the first to seventh developing rollers 17A to 17G and the first to sixth circumferential speed ratios at each of the first drum circumferential speed and the second drum circumferential speed, and the evaluation results entry columns for filling the evaluation results of the first printing image 110 and the second printing image 111 produced under these development conditions are shown in a matrix shape. In FIG. 11 and FIG. 12, if an evaluation result on the first printing image 110 and the second printing image 111 was obtained in which no jitter occurred and the image quality was good since the image density was equal to or more than a specified value, a mark of "circle" was filled in the corresponding column of the evaluation results entry columns. In FIG. 11 and FIG. 12, if an evaluation result on the first printing image 110 and the second printing image 111 was obtained in which some jitter occurred and the image quality was no good as not satisfying the minimum, a mark of "x" was filled in the corresponding column of the evaluation results entry columns. In FIG. 11 and FIG. 12, if an evaluation result on the first printing image 110 and the second printing image 111 was obtained in which, it was subtle though some jitter occurred, and the image quality indicated no problem since the image density was equal to or more than a specified value, a mark of "triangle" was filled in the corresponding column of the evaluation results entry columns. In FIG. 11 and FIG. 12, if an evaluation result on the first printing image 110 and the second printing image 111 was obtained in which the image quality was no good due to occurrence of image failures other than jitters, a mark of "black square" was filled in the corresponding column of the evaluation results entry columns.

In this situation, in a case where the first printing image 110 was subject to a development condition that the thickness of the elastic layer of the developing roller 17 was 2.5 mm or less and that the circumferential speed ratio was in a range from 1.10 to 1.45, no jitter or hardly noticeable jitter occurred regardless the circumferential speed of the photosensitive drum 15. Particularly, in a case where the circumferential speed of the photosensitive drum 15 was the first drum circumferential speed, occurrences of jitter were reduced even where the circumferential speed ratio was in a range from 1.10 to 1.24 and the thickness of the elastic layer was 2.5 mm or more. In a case where the circumferential speed of the photosensitive drum 15 was the second drum circumferential speed, occurrences of jitter were suppressed even where the circumferential speed ratio was in a range from 1.10 to 1.34 and the thickness of the elastic layer was 2.5 mm or more. This is thought that, because fluctuation of the pressing tension force and the returning force, exerting to the roller pressing portion, tends to be smaller as the circumferential speed ratio is smaller, because the hardness of the elastic layer tends to be apparently higher or namely harder as the thickness of the elastic layer is thinner, and because the variation of the elastic layer tends to be reduced in appearance as the circumferential speed of the developing roller 17, the photosensitive drum 15 as well, becomes faster, the elastic layer was hardly vibrated, or suppressed to be very small even where vibrated, so that the surface of the photosensitive drum 15 was rarely suffered from development irregularity, or so that the development irregularity occurring on the surface was reduced significantly. Where the first printing image 110 was subject to a development condition that the circumferential speed was set to around 1.60, jitters making the image quality inferior occurred. This is thought that, because fluctuation of the pressing tension force and the returning force, exerting to the roller pressing portion, tends to be larger as the circumferential speed ratio is larger, and because the hardness of the elastic layer tends to be apparently lower as the thickness of the elastic layer is thicker, the elastic layer was vibrated to cause development irregularity on the surface of the photosensitive drum 15. Where the first printing image 110 was subject to a development condition that the circumferential speed was set to around 1.05, density failure in which the image density is lower than the minimum occurred. This is thought that the toner 33 could not be transferred precisely to the surface of the photosensitive drum 15 regardless the thickness of the elastic layer of the developing roller 17 where the circumferential speed ratio was made smaller.

On the other hand, in a case where the second printing image 111 was subject to a development condition that the thickness of the elastic layer of the developing roller 17 was 0.5 mm or more, no jitter occurred regardless the circumferential speed ratio and the circumferential speed of the photosensitive drum 15. The reason is thought that, in addition to substantially the same reason to the case obtaining the evaluation result that the quality of the first printing image 110 was good, or satisfying the minimum, as described above, where the electrostatic latent image was developed with the toner 33, relatively much toner 33 remained at the roller pressing portion or the vicinity thereof on the surface of the developing roller 17 and worked as a vibration absorbing material to absorb the vibration of the elastic layer, so that no development irregularity occurred on the surface of the photosensitive drum 15. In a case where the second printing image 111 was subject to a development condition that the thickness of the elastic layer of the developing roller 17 was 0.3 mm, some fixing failures (dot errors) of the toner 33 occurred at any position of plural dots to which the toner 33 was supposed to be fixed regardless the circumferential speed ratio and the circumferential speed of the photosensitive drum 15. This is thought that, because the hardness of the elastic layer of the developing roller 17 was too high, the toner 33 was made degraded when entering into a gap among the surface of the developing roller 17, the first and second supply rollers 45, 46, and the toner blade 47, and therefore the toner 33 was not transferred to at least a part of the electrostatic latent image on the surface of the photosensitive drum 15, causing occurrences of development failures.

As described above, according to the printing image formation test, in a case where the photosensitive drum 15 is rotated with the first drum circumferential speed, if the electrostatic latent image is developed with the toner 33 under a development condition that the thickness of the elastic layer of the developing roller 17 is in a range from 0.5 mm to 2.5 mm and the developing roller 17 is rotated with a circumferential speed ratio in a range from 1.10 to 1.45 with respect to the photosensitive drum 15, or a development condition that the thickness of the elastic layer of the developing roller 17 is in a range more than 2.5 mm and equal to or less than 5.0 mm and the developing roller 17 is rotated with a circumferential speed ratio in a range from 1.10 to 1.24 with respect to the photosensitive drum 15, and more desirably a development condition that the thickness of the elastic layer of the developing roller 17 is in a range from 0.5 mm to 2.5 mm and the developing roller 17 is rotated with a circumferential speed ratio in a range from 1.10 to 1.34 with respect to the photosensitive drum 15, it is turned out that occurrences of jitter are suppressed in the printing images. According to the printing image formation test, in a case where the photosensitive drum 15 is rotated with the second drum circumferential speed, if the electrostatic latent image is developed with the toner 33 under a development condition that the thickness of the elastic layer of the developing roller 17 is in a range from 0.5 mm to 2.5 mm and the developing roller 17 is rotated with a circumferential speed ratio in a range from 1.10 to 1.60 with respect to the photosensitive drum 15, or a development condition that the thickness of the elastic layer of the developing roller 17 is in a range more than 2.5 mm and equal to or less than 5.0 mm and the developing roller 17 is rotated with a circumferential speed ratio in a range from 1.10 to 1.34 with respect to the photosensitive drum 15, and more desirably a development condition that the thickness of the elastic layer of the developing roller 17 is in a range from 0.5 mm to 2.5 mm and the developing roller 17 is rotated with a circumferential speed ratio in a range from 1.10 to 1.45 with respect to the photosensitive drum 15, or a development condition that the thickness of the elastic layer of the developing roller 17 is in a range more than 2.5 mm and equal to or less than 5.0 mm and the developing roller 17 is rotated with a circumferential speed ratio in a range from 1.10 to 1.24 with respect to the photosensitive drum 15, it is turned out that occurrences of jitter are suppressed in the printing images. According to the printing image formation test, in a case where the printer 1 has a structure to select the circumferential speeds of the photosensitive drum 15 according to the kinds of the printing media 5, if the electrostatic latent image is developed with the toner 33 under a development condition that the thickness of the elastic layer of the developing roller 17 is in a range from 0.5 mm to 2.5 mm and the developing roller 17 is rotated with a circumferential speed ratio in a range from 1.10 to 1.45 with respect to the photosensitive drum 15, or a development condition that the thickness of the elastic layer of the developing roller 17 is in a range more than 2.5 mm and equal to or less than 5.0 mm and the developing roller 17 is rotated with a circumferential speed ratio in a range from 1.10 to 1.24 with respect to the photosensitive drum 15, and more desirably a development condition that the thickness of the elastic layer of the developing roller 17 is in a range from 0.5 mm to 2.5 mm and the developing roller 17 is rotated with a circumferential speed ratio in a range from 1.10 to 1.34 with respect to the photosensitive drum 15, it is turned out that occurrences of jitter are suppressed in the printing images regardless the circumferential speed of the photosensitive drum 15.

As described above, the developing roller 17 has an apparently higher hardness of the elastic layer as the elastic layer has a thinner thickness. To ensure a certain contact amount of the roller pressing portion of the developing roller 17 to the surface of the photosensitive drum 15 in the image forming unit 10, it is required to make larger the pressing force of the surface of the developing roller 17 to the surface of the photosensitive drum 15, as the developing roller 17 has an elastic layer of a thinner thickness. In the image forming unit 10, as the pressing force of the surface of the developing roller 17 to the surface of the photosensitive drum 15 is larger, the surface of the photosensitive drum 15 is more easily worn. With the image forming unit 10, if the surface of the photosensitive drum 15 is worn, the toner images are hardly formed precisely, and as a result, the quality of the printing images becomes degraded. Therefore, to ensure the photosensitive drum 15 to have a good durability as to form the toner images precisely while significantly reducing wearing of the surface, it is required to set the elastic layer of the developing roller 17 having a thickness of, e.g., 2.0 mm or more as already confirmed by this applicant. In consideration of a structure for suppressing occurrences of jitter with respect to the printing images, where the development condition is set for suppressing occurrences of jitter by changing only the thickness of the elastic layer of the developing roller 17, the elastic layer of the developing roller 17 must be very thin such as a thickness less than 2.0 mm, so that good durability of the photosensitive drum 15 is hardly obtainable. According to the printing image formation test, however, to select the development condition for suppressing occurrences of jitter, the thickness of the elastic layer of the developing roller 17 was changed while the circumferential speed ratio of the developing roller 17 to the photosensitive drum 15 was changed. Consequently, according to the printing image formation test, it is turned out that, as the circumferential speed ratio of the developing roller 17 to the photosensitive drum 15 was made smaller, fluctuation of the pressing tension force and the returning force exerting to the roller pressing portion, as a cause of vibration of the elastic layer of the developing roller 17, could be made smaller. In other words, as the circumferential speed ratio of the developing roller 17 to the photosensitive drum 15 was made smaller, fluctuation of the pressing tension force and the returning force exerting to the roller pressing portion could be made smaller, so that it is turned out that occurrences of jitter could be suppressed as far as the circumferential speed ratio was reduced to some extent even where the elastic layer was made thick to some extent for that.

According to the printing image formation test, as shown with a mark of "double circle," where the photosensitive drum 15 is rotated with the first drum circumferential speed, if the electrostatic latent image is developed with the toner 33 under a development condition that the thickness of the elastic layer of the developing roller 17 is set to around 2.0 mm and the developing roller 17 is rotated with a circumferential speed ratio in a range from 1.24 to 1.34 with respect to the photosensitive drum 15, or a development condition that the thickness of the elastic layer of the developing roller 17 is set to a range more than 2.0 mm but around 2.5 mm or less and the developing roller 17 is rotated with a circumferential speed ratio of around 1.24 with respect to the photosensitive drum 15, it is turned out that occurrences of jitter are suppressed in the printing images while ensuring the good durability to the photosensitive drum 15. According to the printing image formation test, where the photosensitive drum 15 is rotated with the second drum circumferential speed, if the electrostatic latent image is developed with the toner 33 under a development condition that the thickness of the elastic layer of the developing roller 17 is in range from 2.0 mm to 2.5 mm and the developing roller 17 is rotated with a circumferential speed ratio in a range from 1.24 to 1.34 with respect to the photosensitive drum 15, it is turned out that occurrences of jitter are suppressed in the printing images while ensuring the good durability to the photosensitive drum 15. According to the printing image formation test, in a case where the printer 1 has a structure to select the circumferential speeds of the photosensitive drum 15, if the electrostatic latent image is developed with the toner 33 under a development condition that the thickness of the elastic layer of the developing roller 17 is set to around 2.0 mm and the developing roller 17 is rotated with a circumferential speed ratio in a range from 1.24 to 1.34 with respect to the photosensitive drum 15, or a development condition that the thickness of the elastic layer of the developing roller 17 is a range more than 2.0 mm but around 2.5 mm or less and the developing roller 17 is rotated with a circumferential speed ratio of around 1.24 with respect to the photosensitive drum 15, it is turned out that occurrences of jitter are suppressed in the printing images while ensuring the good durability to the photosensitive drum 15, regardless the circumferential speed of the photosensitive drum 15.

In the first embodiment, it is turned out that, where the second printing image 111 as two-by-two image is formed, occurrences of jitter can be suppressed under much more development conditions in comparison with a case where the first printing image 110 as the solid image is formed. In the first embodiment, the reason is thought that the toner 33 remaining on the surface of the developing roller 17 when developing the electrostatic latent image, functions as a vibration absorbing material to the elastic layer. Using this presumption, an additional printing image formation test was performed under a development condition developing electrostatic latent images as remaining the toner 33 on the surface of the developing roller 17. Hereinafter, the additionally performed printing image formation test is described. In the printing image formation test, the photosensitive drum 15 was rotated with the first and second drum circumferential speeds in substantially the same way as above. In the printing image formation test, although the first to seventh developing rollers 17A to 17G were used in substantially the same way as above, the first to seventh developing rollers 17A to 17G were rotated with seventh and sixteenth circumferential speeds as the seventh circumferential speed ratio of around 1.75 in addition to the first to sixth circumferential speed ratios by changing the gear ratio between the motor gear 71 and the developing roller gear 62 upon sequentially replacing the developing roller gear 62. In the printing image formation test, by adjusting a voltage value of a direct current voltage applied to the shafts 17Ax to 17GX of the first to seventh developing rollers 17A to 17G from the developing roller power supply 86, the toner remaining rate on the surface was set to 30%. The toner remaining rate TR can be expressed from the following Formula (1):

$$TR=(1-ST/(DT\times SR))\times 100 \quad (1)$$

wherein the toner weight of the toner 33 per unit area on the surface of the photosensitive drum 15 when developing electrostatic latent images is denoted as ST; the toner weight of the toner 33 per unit area on the surface of the first to seventh developing rollers 17A to 17G is denoted as DT; the first to seventh circumferential speed ratios of the first to seventh developing rollers 17A to 17G to the photosensitive drum 15 are denoted as SR. It is to be noted that in the printing image formation test, even where the first to seventh developing rollers 17A to 17G were rotated with the seventh and the sixteenth circumferential speeds in the image forming unit 10, the first supply roller 45 and the second supply roller 46 were rotated in the other rotation direction with the circumferential speed as that of the circumferential speed ratio of around 0.96 with respect to the first to seventh developing rollers 17A to 17G by changing the gear ratio to the developing roller gear 62 upon properly replacing the first supply roller gear 63 and the second supply roller gear 64. In the printing image formation test, printing image formation conditions other than the printing image formation conditions including the development conditions as described above are substantially the same as those in a case of the printing image formation test describe above.

In the printing image formation test, where the printer 1 was set to rotate the photosensitive drum 15 with the first drum circumferential speed and the second drum circumferential speed, the first printing images 110 were formed on the surface of the printing media 5 in substantially the same way as described above while adjusting the voltage value of the direct current voltage applied to the first to seventh developing rollers 17A to 17G from the developing roller power supply 86 at each of the settings to sequentially rotate with the first to seventh circumferential speed ratios in use of the first to seventh developing rollers 17A to 17G. In the printing image formation test, the first printing images 110 formed on the surface of the printing media 5 were evaluated in substantially the same way as described above. Referring to FIG. 13, the evaluated results are described. In FIG. 13, development conditions as various combinations of the thicknesses T of the elastic layers 17AY to 17GY of the first to seventh developing rollers 17A to 17G and the first to seventh circumferential speed ratios at each of the first drum circumferential speed and the second drum circumferential speed, and the evaluation results entry columns for filling the evaluation results of the first printing image 110 produced under these development conditions are shown in a matrix shape. In FIG. 13, in substantially the same way as in FIGS. 11, 12, a mark of "circle," a mark of "x," a mark of "triangle," and a mark of "black square," indicating the evaluation results are shown in the evaluation results entry columns.

In this situation, for the first printing images 110, where the development condition was that the thickness of the elastic layer of the photosensitive drum 17 was set to 0.3 mm or more and the circumferential speed was in a range from 1.10 to 1.45, no jitter or hardly noticeable jitter occurred regardless the circumferential speed of the photosensitive drum 15. Particularly, in a case where the circumferential speed of the photosensitive drum 15 was the first drum circumferential speed, reduction of jitter was improved regardless the thickness of the elastic layer even where the circumferential speed ratio was 1.60, as far as the thickness of the elastic layer was in a range from 0.3 mm to 2.5 mm. In a case where the circumferential speed of the photosensitive drum 15 was the second drum circumferential speed, reduction of jitter was improved regardless the thickness of the elastic layer where the circumferential speed ratio was in a range from 1.60 to 1.75. This is thought that, in addition to substantially the same reasons as those in the situations obtaining the evaluation results such that the quality of the first printing images 110 were good and that the minimum was satisfied, because the toner 33 remaining on the surface of the photosensitive drum 15 absorbed vibration of the elastic layer, no development irregularity occurred on the surface of the photosensitive drum 15, or development irregularity occurred on the surface of the photosensitive drum 15 were significantly reduced. Where the first printing image 110 was subject to a development condition that the circumferential speed ratio was set to 1.75 or a development condition that the circumferential speed ratio was 1.60 and the thickness of the elastic layer was in a range from 3.0 mm to 5.0 mm, jitters making the image quality inferior occurred. This is thought that, where fluctuation of the pressing tension force and the returning force, exerting to the roller pressing portion, tends to be larger as the circumferential speed ratio is larger, and where the hardness of the elastic layer tends to be apparently lower as the thickness of the elastic layer is thicker, the elastic layer was vibrated, but the toner 33 remaining on the surface of the developing roller 17 could not absorb the vibration to cause development irregularity on the surface of the photosensitive drum 15. Where the first printing image 110 was subject to a development condition that the circumferential speed was set to around 1.05, density failure in which the image density is lower than the minimum occurred, regardless the thickness of the elastic layer of the developing roller 17. This is thought that the toner 33 could not be transferred precisely to the surface of the photosensitive drum 15 from the surface of the developing roller 17 where, in addition that the circumferential speed ratio was made smaller, the toner 33 was remained on the surface of the developing roller 17.

As described above, according to the printing image formation test, in a case where the photosensitive drum 15 is rotated with the first drum circumferential speed, if the electrostatic latent image is developed with the toner 33 under a development condition that the toner 33 is remained with a toner remaining rate of 30% on the surface of the developing roller 17, that the thickness of the elastic layer of the developing roller 17 is in a range from 0.3 mm to 5.0 mm, and that the developing roller 17 is rotated with a circumferential speed ratio in a range from 1.10 to 1.45 with respect to the photosensitive drum 15, or a development condition that the thickness of the elastic layer of the developing roller 17 is in a range from 0.3 mm to 2.5 mm and that the developing roller 17 is rotated with a circumferential speed ratio in a range more than 1.45 and equal to or less than 1.60 with respect to the photosensitive drum 15, and more desirably a development condition that the toner 33 is remained with a toner remaining rate of 30% on the surface of the developing roller 17, that the thickness of the elastic layer of the developing roller 17 is in a range from 0.3 mm to 5.0 mm, and that the developing roller 17 is rotated with a circumferential speed ratio in a range from 1.10 to 1.45 with respect to the photosensitive drum 15, it is turned out that occurrences of jitter are suppressed in the first printing images 110. According to the printing image formation test, in a case where the photosensitive drum 15 is rotated with the second drum circumferential speed, if the electrostatic latent image is developed with the toner 33 under a development condition that the toner 33 is remained with a toner remaining rate of 30% on the surface of the developing roller 17, that the thickness of the elastic layer of the developing roller 17 is in a range from 0.3 mm to 5.0 mm, and that the developing roller 17 is rotated with a circumferential speed ratio in a range from 1.10 to 1.75 with respect to the photosensitive drum 15, and more desirably a development condition that the toner 33 is remained with a toner remaining rate of 30% on the surface of the developing roller 17, that the thickness of the elastic layer of the developing roller 17 is in a range from 0.3 mm to 5.0 mm, and that the developing roller 17 is rotated with a circumferential speed ratio in a range from 1.24 to 1.45 with respect to the photosensitive drum 15, a development condition that the thickness of the elastic layer of the developing roller 17 is in a range from 0.3 mm to 2.5 mm and that the developing roller 17 is rotated with a circumferential speed ratio in a range more than 1.45 equal to or less than 1.60 with respect to the photosensitive drum 15, or a development condition that the thickness of the elastic layer of the developing roller 17 is in a range from 0.3 mm to 1.0 mm and that the developing roller 17 is rotated with a circumferential speed ratio in a range more than 1.60 and equal to or less than 1.75 with respect to the photosensitive drum 15, it is turned out that occurrences of jitter are suppressed in the first printing images 110. According to the printing image formation test, in a case where the printer 1 has a structure to select the circumferential speeds of the photosensitive drum 15, if the electrostatic latent image is developed with the toner 33 under a development condition that the toner 33 is remained with a toner remaining rate of 30% on the surface of the developing roller 17, that the thickness of the elastic layer of the developing roller 17 is in a range from 0.3 mm to 5.0 mm, and that the developing roller 17 is rotated with a circumferential speed ratio in a range from 1.10 to 1.45 with respect to the photosensitive drum 15, it is turned out that occurrences of jitter are suppressed in the first printing images 110 regardless the circumferential speed of the photosensitive drum 15. According to the printing image formation test, where the best development condition is considered in combination of the evaluation results shown in FIG. 13 and the evaluation results shown in FIG. 12, it is turned out that occurrences of jitter are suppressed in the printing images regardless the circumferential speed of the photosensitive drum 15 if the electrostatic latent image is developed with the toner 33 under a development condition that the toner 33 is remained with a toner remaining rate of 30% on the surface of the developing roller 17, that the thickness of the elastic layer of the developing roller 17 is in a range from 0.5 mm to 5.0 mm, and that the developing roller 17 is rotated with a circumferential speed ratio in a range from 1.10 to 1.45 with respect to the photosensitive drum 15.

According to the printing image formation test, where the evaluation results of the first printing images 110 are compared with conditions ensuring a good durability of the photosensitive drum 15, as shown with "double circle" in FIG. 13, in a case where the photosensitive drum 15 is rotated with the first drum circumferential speed, if the electrostatic latent image is developed with the toner 33 under a development condition that the toner 33 is remained with a toner remaining rate of 30% on the surface of the developing roller 17, that the thickness of the elastic layer of the developing roller 17 is in a range from 2.0 mm to 5.0 mm, and that the developing roller 17 is rotated with a circumferential speed ratio of around 1.34 with respect to the photosensitive drum 15, or a development condition that the toner 33 is remained with a toner remaining rate of 30% on the surface of the developing roller 17, that the thickness of the elastic layer of the developing roller 17 is in a range from 2.0 mm to 2.5 mm, and that the developing roller 17 is rotated with a circumferential speed ratio in a range more than 1.34 and equal to or less than 1.45 with respect to the photosensitive drum 15, it is turned out that occurrences of jitter are suppressed in the first printing images 110 while ensuring the good durability for the photosensitive drum 15. According to the printing image formation test, in a case where the photosensitive drum 15 is rotated with the second drum circumferential speed, if the electrostatic latent image is developed with the toner 33 under a development condition that the toner 33 is remained with a toner remaining rate of 30% on the surface of the developing roller 17, that the thickness of the elastic layer of the developing roller 17 is in a range from 2.0 mm to 5.0 mm, and that the developing roller 17 is rotated with a circumferential speed ratio from 1.34 to 1.45 with respect to the photosensitive drum 15, it is turned out that occurrences of jitter are suppressed in the first printing images 110 while ensuring the good durability for the photosensitive drum 15. According to the printing image formation test, in a case where the printer 1 has a structure selecting circumferential speeds of the photosensitive drum 15, if the electrostatic latent image is developed with the toner 33 under a development condition that the toner 33 is remained with a toner remaining rate of 30% on the surface of the developing roller 17, that the thickness of the elastic layer of the developing roller 17 is in a range from 2.0 mm to 2.5 mm, and that the developing roller 17 is rotated with a circumferential speed ratio from 1.34 to 1.45 with respect to the photosensitive drum 15, or a development condition that the thickness of the elastic layer of the developing roller 17 is in a range more than 2.5 mm and equal to or less than 5.0 mm, and that the developing roller 17 is rotated with a circumferential speed ratio of around 1.34 with respect to the photosensitive drum 15, it is turned out that occurrences of jitter are suppressed in the first printing images 110 while ensuring the good durability for the photosensitive drum 15, regardless the circumferential speed of the photosensitive drum 15. According to the printing image formation test, even where the evaluation results shown in FIG. 13 are compared with the evaluation results shown in FIG. 12, if the electrostatic latent image is developed with the toner 33 under a development condition that the toner 33 is remained with a toner remaining rate of 30% on the surface of the developing roller 17, that the thickness of the elastic layer of the developing roller 17 is in a range from 2.0 mm to 2.5 mm, and that the developing roller 17 is rotated with a circumferential speed ratio from 1.34 to 1.45 with respect to the photosensitive drum 15, it is turned out that occurrences of jitter are suppressed in the printing images while ensuring the good durability for the photosensitive drum 15, regardless the circumferential speed of the photosensitive drum 15.

As conventional printers, printers other than the printers described in the section of related art have been known in which an output shaft of a unit drive motor is coupled only to a shaft of the photosensitive drum as making a transmission route of drive force from the single unit drive motor to the image forming unit as one system line, in which a drum gear secured to the shaft of the photosensitive drum is meshed with a developing roller gear, and in which the developing roller gear is coupled to a first supply roller gear and a second supply roller gear via single or plural intermediate gears. However, this applicant confirmed that, in such a conventional printer, the drive force is transmitted from the unit drive motor to the photosensitive drum, and the drive force is transmitted to the developing roller, the first supply roller, and the second supply roller via the developing roller gear, the first supply roller gear, and the second supply roller gear from the drum gear of the photosensitive drum, so that the drum gear and the developing roller gear are easily vibrated due to a significantly enlarged load exerted to the drum gear when the developing roller, the first supply roller, and the second supply roller are rotated according to rotation of the photosensitive drum, and so that jitters may occur not only on the solid image but also on two-by-two image. With the first embodiment, therefore, in the printer 1 as described above, the transmission route from the single unit drive motor 60 to the image forming unit 10 is divided into two system lines, a first drive force transmission route transmitting to the photosensitive drum 15, and a second drive force transmission route transmitting to, e.g., the developing roller 17. With this structure, in the first embodiment, when the developing roller 17, the first supply roller 45, and the second supply roller 46 are rotated together with the photosensitive drum 15 in the printer 1, vibration of the developing roller gear 62 is reduced in comparison with the conventional printer. Consequently, in the first embodiment, as apparent from FIG. 12, even where the two-by-two image is formed on the surface of the printing media 5 by means of the printer 1, occurrences of jitters are suppressed in the two-by-two image. In the first embodiment, where the printer 1 forms a solid image on the printing media 5, jitters occurring on the solid image are reduced in comparison with the conventional printer. With the first embodiment, jitters occurring on a solid image even though the transmission route of the drive force is divided into the two system lines, can be reduced by selecting an optimum development condition as described above.

(i-5) Operation and Advantages of the First Embodiment

The printer 1, at a time of printing image formation, transmits the drive force from the unit drive motor 60 via the first drive force transmission route to the photosensitive drum 15 of the image forming unit 10 to rotate the photosensitive drum 15 in the one rotation direction, and transmits the drive force via the second drive force transmission route to the developing roller having the elastic layer, the first supply roller 45, and the second supply roller 46 of the image forming unit 10 to rotate those rollers in the other rotation direction. The printer 1, while rotating those rollers, forms the electrostatic latent images on the surface of the photosensitive drum 15, forms toner images by developing the latent image with the toner 33 via the developing roller 17, and forms printing images on the surface of the printing media 5 based on the toner images. At that time, the printer 1 develops the electrostatic latent images with the toner 33 under a development condition that the thickness of the elastic layer of the developing roller 17 is in a range from 0.5 mm to 2.5 mm, and that the developing roller 17 is rotated with a circumferential speed ratio in a range from 1.10 to 1.45 with respect to the photosensitive drum 15, or a development condition that the thickness of the elastic layer of the developing roller 17 is in a range more than 2.5 mm and equal to or less than 5.0 mm, and that the developing roller 17 is rotated with a circumferential speed ratio in a range from 1.10 to 1.24 with respect to the photosensitive drum 15, and more suitably a development condition that the thickness of the elastic layer of the developing roller 17 is in a range from 0.5 mm to 2.5 mm, and that the developing roller 17 is rotated with a circumferential speed ratio in a range from 1.10 to 1.34 with respect to the photosensitive drum 15. With those conditions, the printer 1 can suppress occurrences of jitters on the printing images and can prevent the image quality from becoming inferior.

The printer 1 develops the electrostatic latent images with the toner 33 under a development condition that the thickness of the elastic layer of the developing roller 17 is set to around 2.0 mm, and that the developing roller 17 is rotated with a circumferential speed ratio in a range from 1.24 to 1.34 with respect to the photosensitive drum 15, or a development condition that the thickness of the elastic layer of the developing roller 17 is in a range more than 2.0 mm and equal to or less than 2.5 mm, and that the developing roller 17 is rotated with a circumferential speed ratio of around 1.24 with respect to the photosensitive drum 15. With those conditions, the printer 1 can suppress occurrences of jitters on the printing images while ensuring the good durability for the photosensitive drum 15. The printer 1 therefore can prevent the image quality of the printing images from being deteriorated due to jitters, and can prevent durations of the photosensitive drum 15 and the printer 1 from becoming shorter.

The printer 1 develops the electrostatic latent images with the toner 33 under a development condition that the toner 33 is remained with a toner remaining rate of 30% on the surface of the developing roller 17. With this condition, in the printer 1, a selection range of the development condition of the electrostatic latent images can be made wider so that the thickness of the elastic layer of the developing roller 17 is in a range from 0.5 mm to 5.0 mm, and so that the developing roller 17 is rotated with a circumferential speed ratio from 1.10 to 1.45 with respect to the photosensitive drum 15, and therefore, the printer 1 can remarkably improve flexibility on selection of the development conditions and flexibility on design of the printer 1. Where making wider the range of the development conditions, the printer 1 can suppress occurrences of jitters on the printing images while ensuring the good durability for the photosensitive drum 15 even where developing the electrostatic latent images with the toner 33 under a development condition that the thickness of the elastic layer of the developing roller 17 is in a range from 2.0 mm to 2.5 mm, and that the developing roller 17 is rotated with a circumferential speed ratio in a range from 1.34 to 1.45 with respect to the photosensitive drum 15, or a development condition that the thickness of the elastic layer of the developing roller 17 is in a range more than 2.5 mm and equal to or less than 5.0 mm, and that the developing roller 17 is rotated with a circumferential speed ratio of around 1.34 with respect to the photosensitive drum 15. The printer 1 therefore can prevent the image quality of the printing images from being deteriorated due to jitters, and can remarkably improve flexibility on design paying attention to the duration of the printer 1.

Second Embodiment (ii-1) Structure of the Printer

A structure of the printer 1 according to the second embodiment is described. The printer 1 has the same internal structure and circuit structure as those in the printer 1 according to the first embodiment. The internal structure of the printer 1 and the image forming unit 10 according to the second embodiment are omitted from a description herein as referring to the above description using FIG. 1 to FIG. 6.

(ii-2) Printing Image Formation Test

In the printing image formation test according to the first embodiment described above, it is turned out that occurrences of jitters can be suppressed in the printing images, where the electrostatic latent images are developed with the toner 33 under a development condition that the toner 33 is remained with a toner remaining rate of 30% on the surface of the developing roller 17. In the second embodiment, using the printer 1 described above, the toner images were formed by developing electrostatic latent images under various development conditions changing the toner remaining rate on the surface of the developing roller 17 in the image forming unit 10, and a printing image formation test forming printing images on the surface of the printing media 5 based on the toner images, was performed to evaluate existence of the occurrences of jitters to the printing images and the image quality. Hereinafter, the printing image formation test and the evaluation results of the printing images are described. First, in the printing image formation test, the photosensitive drum 15 was rotated with the first drum circumferential speed and the second drum circumferential speed in substantially the same manner as in the printing image formation test according to the first embodiment, and the first to seventh developing rollers 17A to 17G were used. In the printing image formation test, the circumferential speed ratio of the first to seventh developing rollers 17A to 17G to the photosensitive drum 15 was set to only fourth circumferential speed ratio. In the printing image formation test, to change the development condition, the voltage value of the direct current voltage applied from the developing roller power supply 86 to the first to seventh developing rollers 17A to 17G was adjusted to set the toner remaining rate on the surface of the first to seventh developing rollers 17A to 17G as, e.g., first to sixth toner remaining rates. The first to sixth toner remaining rates were around 0%, 5%, 20%, 30%, 40%, and 45%. In the printing image formation test, the printing image formation conditions other than the printing image formation conditions including the development conditions described above were substantially the same as those in the printing image formation test according to the first embodiment.

In the printing image formation test, the printer 1 was set so that the photosensitive drum 15 was rotated with the first drum circumferential speed and the second drum circumferential speed, and the voltage value of the direct current voltage applied from the developing roller power supply 86 was adjusted by using the first to seventh developing rollers 17A to 17G sequentially. The first printing images 110 were formed on the surface of the printing media 5 in substantially the same manner as those according to the first embodiment at each of settings of the first to sixth toner remaining rates as the toner remaining rate. In the printing image formation test, the printer 1 was set so that the photosensitive drum 15 was rotated with the first drum circumferential speed and the second drum circumferential speed, and the voltage value of the direct current voltage applied from the developing roller power supply 86 was adjusted by using the first to seventh developing rollers 17A to 17G sequentially. The second printing images 111 were formed on the surface of the printing media 5 in substantially the same manner as those according to the first embodiment at each of settings of the first to sixth toner remaining rates as the toner remaining rate. In the printing image formation test, the first printing images 110 and the second printing images 111 formed on the surface of the printing media 5 were evaluated in substantially the same manner as those according to the first embodiment described above. Using FIG. 14 and FIG. 15, the evaluation results are described. FIG. 14 and FIG. 15 show development conditions as various combinations of the thicknesses T of the elastic layers 17AY to 17GY of the first to seventh developing rollers 17A to 17G and the first to sixth toner remaining rates at each of the first drum circumferential speed and the second drum circumferential speed, and evaluation results entry columns for filling the evaluation results of the first printing images 110 and the second printing images 111 produced under these development conditions, in a matrix shape. In FIGS. 14, 15, in substantially the same way as in FIGS. 11, 12, a mark of "circle," a mark of "x," a mark of "triangle," and a mark of "black square," indicating the evaluation results are shown in the plural evaluation results entry columns.

In this situation, for the first printing images 110, in a case of a development condition that the thickness of the elastic layer of the developing roller 17 was 0.3 mm or more and that the toner remaining rate was in a range from 20% to 40%, no jitter or hardly noticeable jitter occurred regardless the circumferential speed of the photosensitive drum 15. Particularly, where the elastic layer has a thin thickness, even in a case that the toner remaining rate was 5% or less, jitter reduction was improved regardless the circumferential speed of the photosensitive drum 15. This is because, though the elastic layer of the developing roller 17 was vibrated, no development irregularity on the surface of the photosensitive drum 15 occurred, or any development irregularity on the surface was significantly reduced, since the toner 33 remaining on the surface worked as a vibration absorbing material to absorb the vibration. With the first printing images 110, in a case that the circumferential speed of the photosensitive drum 15 was the first drum circumferential speed, some jitter making the image quality inferior occurred where the thickness of the elastic layer was set to 5.0 mm or more even though the toner remaining rate was set to 0%. With the first printing images 110, in a case that the circumferential speed of the photosensitive drum 15 was the second drum circumferential speed, some jitter making the image quality inferior occurred where the thickness of the elastic layer was set to 3.0 mm or more even though the toner remaining rate was set to 0%. This is thought that the toner 33 remaining on the surface of the developing roller 17 was relatively a small amount, and therefore, the variation of the elastic layer was not absorbed by the toner 33. With the first printing images 110, in a case of the development condition that the toner remaining rate was 45%, some density failure having a lower image density than the minimum value occurred though no jitter occurred, regardless the thickness of the elastic layer and the circumferential speed of the photosensitive drum 15. This is thought that where the toner 33 remained in relatively large amount on the surface of the developing roller 17, the toner 33 transferred from the surface to the surface of the photosensitive drum 15 was reduced.

To the contrary, with the second printing images 111, in a case of the development condition that the thickness of the elastic layer of the developing roller 17 is set to 0.5 mm or more, no jitter occurred regardless the toner remaining rate and the circumferential speed of the photosensitive drum 15. This is thought that no development irregularity occurred on the surface of the photosensitive drum 15 because the toner 33 remaining on the surface of the developing roller 17 absorbed vibration even though the elastic layer was vibrated. In a case where the second printing image 111 was subject to a development condition that the thickness of the elastic layer of the developing roller 17 was 0.3 mm, some fixing failures (dot errors) of the toner 33 occurred at any position of plural dots to which the toner 33 was supposed to be fixed regardless the toner remaining rate and the circumferential speed of the photosensitive drum 15. This is thought that, because the hardness of the elastic layer of the developing roller 17 was too high, the toner 33 was made degraded when entering into a gap among the surface of the developing roller 17, the first and second supply rollers 45, 46, and the toner blade 47, and therefore the toner 33 was not transferred to at least a part of the electrostatic latent image on the surface of the photosensitive drum 15, causing occurrences of development failures.

According to described above, in the printing image formation test, in a case where the photosensitive drum 15 is rotated with the first drum circumferential speed, if the electrostatic latent image is developed with the toner 33 under a development condition that the thickness of the elastic layer of the developing roller 17 is in a range from 0.5 mm to 5.0 mm and that the toner 33 is remained with a toner remaining rate in a range from 20% to 40% on the surface of the developing roller 17, or a development condition that the thickness of the elastic layer of the developing roller 17 is in a range from 0.5 mm to 2.5 mm and that the toner 33 is remained with a toner remaining rate in a range equal to or more than 5% and less than 20% on the surface of the developing roller 17, and more desirably a development condition that the thickness of the elastic layer of the developing roller 17 is in a range from 0.5 mm to 5.0 mm, that the toner 33 is remained with a toner remaining rate of around 40% on the surface of the developing roller 17, a development condition that the thickness of the elastic layer of the developing roller 17 is in a range from 0.5 mm to 3.0 mm and that the toner 33 is remained with a toner remaining rate equal to or more than 30% and less than 40% on the surface of the developing roller 17, a development condition that the thickness of the elastic layer of the developing roller 17 is in a range from 0.5 mm to 2.5 mm and that the toner 33 is remained with a toner remaining rate equal to or more than 20% and less than 30% on the surface of the developing roller 17, or a development condition that the thickness of the elastic layer of the developing roller 17 is set to around 0.5 mm and that the toner 33 is remained with a toner remaining rate equal to or more than 5% and less than 20% on the surface of the developing roller 17, it is turned out that occurrences of jitter are suppressed in the printing images. In the printing image formation test, in a case where the photosensitive drum 15 is rotated with the second drum circumferential speed, if the electrostatic latent image is developed with the toner 33 under a development condition that the thickness of the elastic layer of the developing roller 17 is in a range from 0.5 mm to 5.0 mm and that the toner 33 is remained with a toner remaining rate in a range from 5% to 40% on the surface of the developing roller 17, or a development condition that the thickness of the elastic layer of the developing roller 17 is in a range from 0.5 mm to 2.5 mm and that the toner 33 is remained with a toner remaining rate in a range equal to or more than 0% and less than 5% on the surface of the developing roller 17, and more desirably a development condition that the thickness of the elastic layer of the developing roller 17 is in a range from 0.5 mm to 5.0 mm, that the toner 33 is remained with a toner remaining rate from 20% to 40%, a development condition that the thickness of the elastic layer of the developing roller 17 is in a range from 0.5 mm to 2.5 mm and that the toner 33 is remained with a toner remaining rate equal to or more than 5% and less than 20% on the surface of the developing roller 17, a development condition that the thickness of the elastic layer of the developing roller 17 is in a range from 0.5 mm to 1.0 mm and that the toner 33 is remained with a toner remaining rate equal to or more than 0% and less than 5% on the surface of the developing roller 17, it is turned out that occurrences of jitter are suppressed in the printing images. In the printing image formation test, in a case of a structure selecting the circumferential speeds of the photosensitive drum 15, if the electrostatic latent image is developed with the toner 33 under a development condition that the thickness of the elastic layer of the developing roller 17 is in a range from 0.5 mm to 5.0 mm and that the toner 33 is remained with a toner remaining rate in a range from 20% to 40% on the surface of the developing roller 17, or a development condition that the thickness of the elastic layer of the developing roller 17 is in a range from 0.5 mm to 2.5 mm and that the toner 33 is remained with a toner remaining rate in a range equal to or more than 5% and less than 20% on the surface of the developing roller 17, and more desirably a development condition that the thickness of the elastic layer of the developing roller 17 is in a range from 0.5 mm to 5.0 mm, that the toner 33 is remained with a toner remaining rate of around 40% on the surface of the developing roller 17, a development condition that the thickness of the elastic layer of the developing roller 17 is in a range from 0.5 mm to 3.0 mm and that the toner 33 is remained with a toner remaining rate equal to or more than 30% and less than 40% on the surface of the developing roller 17, a development condition that the thickness of the elastic layer of the developing roller 17 is in a range from 0.5 mm to 2.5 mm and that the toner 33 is remained with a toner remaining rate equal to or more than 20% and less than 30% on the surface of the developing roller 17, or a development condition that the thickness of the elastic layer of the developing roller 17 is set to around 0.5 mm and that the toner 33 is remained with a toner remaining rate equal to or more than 5% and less than 20% on the surface of the developing roller 17, it is turned out that occurrences of jitter are suppressed in the printing images.

Figure 16:
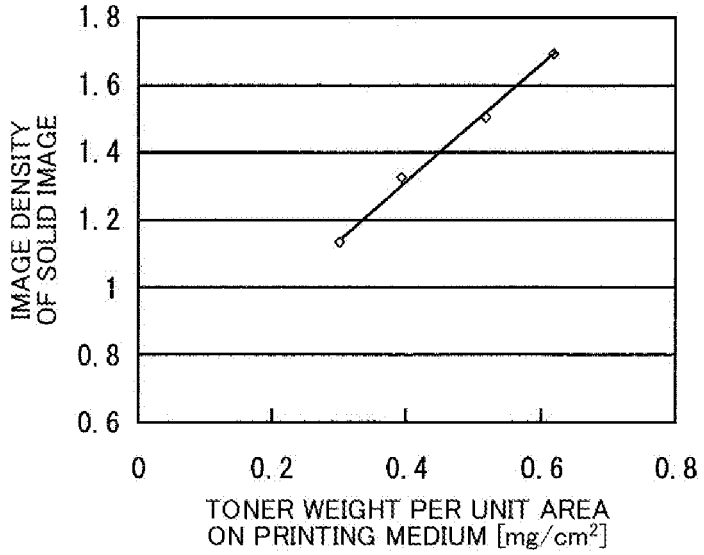
FIG. 16 is a graph showing a relationship between toner weight of toner on a printing medium and image density.
Figure 17:
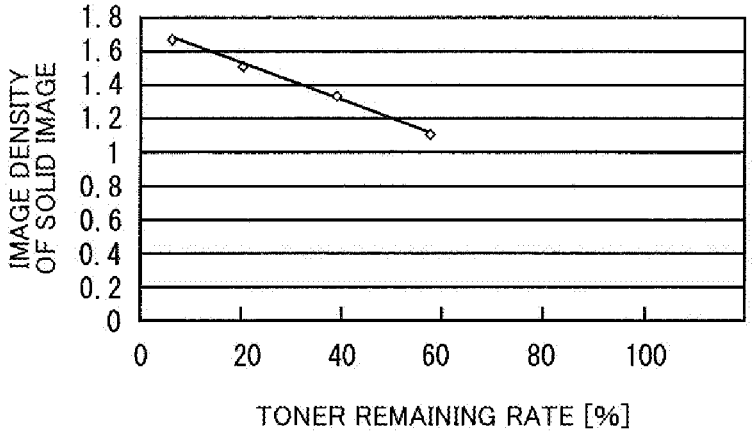
FIG. 17 is a graph showing a relationship between toner remaining rate and image density.

As shown in FIG. 16, the solid image formed on the surface of the printing media 5 has a higher image density as the toner weight per unit area of the toner 33 on the printing media 5 increases further. In the printer 1, if the minimum of the image density of the solid image is, e.g., 1.20, it is required to form the solid image on the surface of the printing media 5 so that the toner weight per unit area of the toner 33 is 0.34 mg/cm$^2$ or more. As shown in FIG. 17, in the printing image formation test, where, in the printer 1, the electrostatic latent images on the surface of the photosensitive drum 15 are developed as the developing roller 17 is rotated in the other rotation direction with the circumferential speed of the circumferential speed ratio of around 1.34 with respect to the photosensitive drum 15 while setting the toner weight of around 0.45 mg/cm$^2$ per unit area of the toner 33 carried on the surface of the developing roller 17, and where the toner 33 as the toner images on the surface of the photosensitive drum 15 is transferred to the surface of the printing media 5 with a rate of around 95%, it is turned out that the toner weight of the toner 33 per unit area on the surface of the printing media 5 goes down to 0.34 mg/cm$^2$ or less, and that image density failures may occur because the image density of the solid image becomes lower than 1.20 as the minimum, if the toner remaining rate of the toner 33 remaining on the surface of the developing roller 17 goes up to 40% or more. According to the printing image formation test, it is assumed that no jitter occurs in the solid image and that images can be formed with a good image quality where the image density is equal to or more than 1.20 as the minimum, even though the toner remaining rate of the toner 33 remaining on the surface of the developing roller 17 is set to a rate more than 40%, if the electrostatic latent image on the surface of the photosensitive drum 15 is developed as increasing the toner weight of the toner 33 per unit area carried on the surface of the developing roller 17 to be more than 0.45 mg/cm$^2$ and as rotating the developing roller 17 in the other rotation direction with the circumferential speed of the circumferential speed ratio lager than 1.34 with respect to the photosensitive drum 15. However, in fact, if the toner weight of the toner 33 per unit area carried on the surface of the developing roller 17 in the printer 1 is increased too much, the amount of the toner 33 to be transferred to the surface of the photosensitive drum 15 from the surface of the developing roller 17 is hardly controlled precisely at a time of the development of the electrostatic latent images, and for example, where the toner 33 in an amount more than required, is transferred from the developing roller 17 to the surface of the photosensitive drum 15, the toner 33 may appear as stains on the surface of the printing media 5. In the printing image formation test, the toner weight of the toner 33 per unit area carried on the surface of the developing roller 17 was researched. In a case where the toner remaining rate of the toner 33 remaining on the surface of the developing roller 17 is made very high while the amount of the toner 33 to be transferred to the surface of the photosensitive drum 15 from the surface of the developing roller 17 is controlled precisely at a time of the development of the electrostatic latent images in the printer 1, it is turned out that, while the toner 33 is functioned precisely as a vibration absorbing material, no jitter in the solid image occurs, and that images can be formed with the good image quality having the image density of 1.20 as the minimum or more, if the toner weight of the toner 33 per unit area carried on the surface of the developing roller 17 is set to, e.g., a range from 0.45 to 0.75 mg/cm$^2$, preferably a range from 0.55 to 0.65 mg/cm$^2$, particularly around 0.6 mg/cm$^2$, even though the toner remaining rate of the toner 33 remaining on the surface of the developing roller 17 is set to an amount higher than 40% to some extent.

In the printing image formation test, though the circumferential speed ratio of the first to seventh developing rollers 17A to 17G to the photosensitive drum 15 was set to around 1.34, on the basis of the evaluation results of the printing image formation test according to the first embodiment described above, occurrences of jitters can be suppressed in the printing images if the electrostatic latent images are developed by the toner 33 under a development condition that the thickness of the elastic layer of the developing roller 17 is in a range from 0.5 mm to 2.5 mm and that the toner 33 is remained with a toner remaining rate in a range from 5% to 40% on the surface of the developing roller 17, and more suitably a development condition that the thickness of the elastic layer of the developing roller 17 is in a range from 0.5 mm to 2.5 mm and that the toner 33 is remained with a toner remaining rate in a range from 20% to 40% on the surface of the developing roller 17, even where the circumferential speed ratio of the developing roller 17 with respect to the photosensitive drum 15 is changed in a range from 1.10 to 1.45.

(ii-3) Operation and Advantages of the Second Embodiment

The printer 1, at a time of printing image formation, transmits the drive force from the unit drive motor 60 via the first drive force transmission route to the photosensitive drum 15 of the image forming unit 10 to rotate the photosensitive drum 15 in the one rotation direction, and transmits the drive force via the second drive force transmission route to the developing roller having the elastic layer, the first supply roller 45, and the second supply roller 46 of the image forming unit 10 to rotate those rollers in the other rotation direction. The printer 1, while rotating those rollers, forms the electrostatic latent images on the surface of the photosensitive drum 15, forms toner images by developing the latent image with the toner 33 via the developing roller 17, and forms printing images on the surface of the printing media 5 based on the toner images. At that time, the printer 1 develops the electrostatic latent images with the toner 33 under a development condition that the thickness of the elastic layer of the developing roller 17 is in a range from 0.5 mm to 5.0 mm and that the toner 33 is remained with a toner remaining rate in a range from 20% to 40% on the surface of the developing roller 17, or a development condition that the thickness of the elastic layer of the developing roller 17 is in a range from 0.5 mm to 2.5 mm and that the toner 33 is remained with a toner remaining rate in a range more than 5% and equal to or less than 20% on the surface of the developing roller 17, and more suitably a development condition that the thickness of the elastic layer of the developing roller 17 is in a range from 0.5 mm to 5.0 mm and that the toner 33 is remained with a toner remaining rate of around 40% on the surface of the developing roller 17, a development condition that the thickness of the elastic layer of the developing roller 17 is in a range from 0.5 mm to 3.0 mm and that the toner 33 is remained with a toner remaining rate in a range more than 30% and equal to or less than 40% on the surface of the developing roller 17, a development condition that the thickness of the elastic layer of the developing roller 17 is in a range from 0.5 mm to 2.5 mm and that the toner 33 is remained with a toner remaining rate in a range more than 20% and equal to or less than 30% on the surface of the developing roller 17, or a development condition that the thickness of the elastic layer of the developing roller 17 is set to around 0.5 mm and that the toner 33 is remained with a toner remaining rate in a range more than 5% and equal to or less than 20% on the surface of the developing roller 17. With those conditions, the printer 1 can suppress occurrences of jitters on the printing images and can prevent the image quality from becoming inferior.

Other Embodiments (iii-1) Other Embodiment #1

In the first and second embodiments, described are structures having the first and second supply rollers 45, 46 in the image forming unit 10, but this invention is not limited to this structure, and the image forming unit 10 may have a single supply roller, or have three or more supply rollers.

(iii-2) Other Embodiment #2

In the first and second embodiments described above, the structure that the developing roller 17 and the developing unit coupling 66 are coupled in meshing the developing roller gear 62 with the coupling gear 65 is described. This invention is, however, not limited to this structure, an end of the shaft of the developing roller 17 may be attached to the developing unit coupling 66 in a way to rotate together with the shaft. With this structure, this invention can suppress occurrences of jitters in the printing images in substantially the same way as those in the first and second embodiments described above by suppressing the vibrations even where the backlash between the developing unit coupling 66 and the development side coupling 75 causes vibrations of the elastic layer of the developing roller 17. With such a structure, in this invention, the developing unit coupling 66 attached to the shaft of the developing roller 17 may be coupled to the first and second supply roller gears 45, 46 via the coupling gear 65, the second supply roller gear 64, the intermediate gear 67, and the first supply roller gear 63. The invention, with the structure above, may couple the unit drive motor 60 with the first supply roller 45 and the second supply roller 46 via a pair of couplings or via single or plural gears forming a third drive force transmission route as different from the first and second drive force transmission routes.

(iii-3) Other Embodiment #3

In the first and second embodiments described above, the structure that the image forming unit according to the invention applies to the image forming unit 10 detachably attached to the printer 10 described above in referring to FIG. 1 to FIG. 17 is described. This invention is, however, not limited to this structure, but widely applicable to image forming units of various other structures such as one or plural image forming units detachably attached to or securely arranged to image forming apparatuses capable of forming printing images such as, e.g., monochrome electrophotographic printers of intermediate transfer types, multicolor electrophotographic printers of direct transfer types, multicolor electrophotographic printers of intermediate transfer types, multifunction printers, facsimile machines, MFPs (multifunction peripherals), and photocopiers.

(iii-4) Other Embodiment #4

In the first and second embodiments described above, the structure that the image forming apparatus according to the invention applies to the monochrome printer 1 of the direct transfer type described above in referring to FIG. 1 to FIG. 17 is described. This invention is, however, not limited to this structure, but widely applicable to image forming apparatuses of other structures such as, e.g., monochrome electrophotographic printers of intermediate transfer types, multicolor electrophotographic printers of direct transfer types, multicolor electrophotographic printers of intermediate transfer types, multifunction printers, facsimile machines, MFPs (multifunction peripherals), and photocopiers.

(iii-5) Other Embodiment #5

In the first and second embodiments described above, the structure that the photosensitive drum 15 described above in referring to FIG. 1 to FIG. 17 applies an image carrier rotating from the drive force transmitted via the first drive force transmission route and forming electrostatic latent images on the surface, is described. This invention is, however, not limited to this structure, but widely applicable to image carriers of other various structures such as, e.g., inorganic photosensitive drums having a drum body formed with a photosensitive layer of a prescribed thickness made of, e.g., selenium or amorphous silicon on the entire outer peripheral surface of a conductive metal pipe made of such as, e.g., aluminum, and organic photosensitive drums having a drum body formed with an organic photosensitive layer of a prescribed thickness made by dispersing electron generating agents and the charge transfer agents in a binder resin on the entire outer peripheral surface of a conductive metal pipe made of such as, e.g., aluminum.

(iii-6) Other Embodiment #6

In the first and second embodiments described above, the structure that the developing roller 17 described above in referring to FIG. 1 to FIG. 17 applies a developer carrier having an elastic layer carrying a developer on a surface thereof, rotating according to drive force transmitted via the second drive force transmission route, and developing electrostatic latent images with a developer, is described. This invention is, however, not limited to this structure, but widely applicable to developer carriers of other various structures such as, e.g., a developing belt tensioned with plural rollers supported rotatably and formed as cover the entire outer peripheral surface of the belt body of the endless type with an elastic layer having a prescribed uniform thickness.

(iii-7) Other Embodiment #7

In the first and second embodiments described above, the structure that the first drive force transmission route formed with the drum side coupling gear 72, the drum side coupling 73, and the drum coupling 61, described above in referring to FIG. 1 to FIG. 17 applies, as the first drive force transmission route transmitting the drive force to the image carrier, is described. This invention is, however, not limited to this structure, but widely applicable to the first drive force transmission routes of other various structures such as, e.g., a first drive force transmission route formed with a drum gear secured to the shaft of the photosensitive drum 15, a shaft rotatably supported, a gear secured to an end of the shaft in meshing a drum gear, and a gear secured to the other end of the shaft in meshing the motor gear 71.

(iii-8) Other Embodiment #8

In the first and second embodiments described above, the structure that the second drive force transmission route formed with the development side coupling gear 74, the development side coupling 75, the developing unit coupling 66, the coupling gear 65, and the developing roller gear 62, described above in referring to FIG. 1 to FIG. 17 applies, as the second drive force transmission route transmitting the drive force to the developer carrier, is described. This invention is, however, not limited to this structure, but widely applicable to the second drive force transmission routes of other various structures such as, e.g., a second drive force transmission route formed with the developing roller gear 62, a shaft rotatably supported, a gear secured to an end of the shaft in meshing the developing roller gear 62, and a gear secured to the other end of the shaft in meshing the motor gear 71.

(iii-9) Other Embodiment #9

In the first and second embodiments described above, the structure that the unit drive motor 60 described above in referring to FIG. 1 to FIG. 17 applies, as the first drive unit for transmitting drive force to the image carrier via the first drive force transmission route and rotating the image carrier, is described. This invention is, however, not limited to this structure, but widely applicable to first drive units of other various structures such as, e.g., a motor for drive of the photosensitive drum 15 provided separately from that for drive of the developing roller 17.

(iii-10) Other Embodiment #10

In the first and second embodiments described above, the structure that the unit drive motor 60 described above in referring to FIG. 1 to FIG. 17 applies, as the second drive unit for transmitting drive force to the developer carrier via the second drive force transmission route and rotating the developer carrier, is described. This invention is, however, not limited to this structure, but widely applicable to second drive units of other various structures such as, e.g., a motor provided separately from that for drive of the photosensitive drum 15, or a motor provided separately from that for drive of photosensitive drum 15, and the first and second supply rollers 45, 46.

This invention can be used for image forming units formed in image forming apparatuses such as, e.g., electrophotographic printers, multifunction printers, facsimile machines, MFPs, and photocopiers, and for image forming apparatuses such as, e.g., electrophotographic printers, multifunction printers, facsimile machines, MFPs, and photocopiers.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image forming unit comprising:

an image carrier rotating by drive force transmitted via a first drive force transmission route and forming an electrostatic latent image on a surface thereof; and a developer carrier having an elastic layer carrying a developer on a surface thereof, rotating by drive force transmitted via a second drive force transmission route, and developing the electrostatic latent image with the developer, wherein the electrostatic latent image is developed with the developer under a development condition that, when the elastic layer of the developer carrier is set to have a thickness in a range from 0.5 mm to 2.5 mm, the developer carrier is rotated with a circumferential speed ratio with respect to the image carrier in a range from 1.10 to 1.34.

2. An image forming apparatus comprising: a first drive unit transmitting drive force to the image carrier via the first drive force transmission route to rotate the image carrier; a second drive unit transmitting drive force to the developer carrier via the second drive force transmission route to rotate the developer carrier; and the image forming unit as set forth in claim 1.

3. An image forming unit comprising:

an image carrier rotating by drive force transmitted via a first drive force transmission route and forming an electrostatic latent image on a surface thereof; and a developer carrier having an elastic layer carrying a developer on a surface thereof, rotating by drive force transmitted via a second drive force transmission route, and developing the electrostatic latent image with the developer, wherein the electrostatic latent image is developed with the developer under one of the following development conditions:

(i) a development condition that, when the elastic layer of the developer carrier is set to have a thickness of 2.0 mm, the developer carrier is rotated with a circumferential speed ratio with respect to the image carrier in a range from 1.24 to 1.34; or (ii) a development condition that, when the elastic layer of the developer carrier is set to have a thickness in a range more than 2.0 mm but not more than 2.5 mm, the developer carrier is rotated with a circumferential speed ratio with respect to the image carrier of 1.24.

4. An image forming unit comprising:

an image carrier rotating by drive force transmitted via a first drive force transmission route and forming an electrostatic latent image on a surface thereof; and a developer carrier having an elastic layer carrying a developer on a surface thereof, rotating by drive force transmitted via a second drive force transmission route, and developing the electrostatic latent image with the developer, wherein the electrostatic latent image is developed with the developer under one of the following development conditions:

(i) a development condition that, when the developer is made remaining on the surface of the developer carrier with a developer remaining rate of 30%, and when the elastic layer of the developer carrier is set to have a thickness in a range from 0.5 mm to 2.5 mm, the developer carrier is rotated with a circumferential speed ratio with respect to the image carrier in a range from 1.10 to 1.60; or (ii) a development condition that, when the developer is made remaining on the surface of the developer carrier with a developer remaining rate of 30%, and when the elastic layer of the developer carrier is set to have a thickness in a range more than 2.5 mm but not more than 5.0 mm, the developer carrier is rotated with a circumferential speed ratio with respect to the image carrier in a range from 1.10 to 1.45.

5. An image forming unit comprising:

an image carrier rotating by drive force transmitted via a first drive force transmission route and forming an electrostatic latent image on a surface thereof; and a developer carrier having an elastic layer carrying a developer on a surface thereof, rotating by drive force transmitted via a second drive force transmission route, and developing the electrostatic latent image with the developer, wherein the electrostatic latent image is developed with the developer under one of the following development conditions:

(i) a development condition that, when the elastic layer of the developer carrier is set to have a thickness in a range from 0.5 mm to 2.5 mm, the developer is made remaining on the surface of the developer carrier with a developer remaining rate in a range from 5% to 40%; or (ii) a development condition that, when the elastic layer of the developer carrier is set to have a thickness in a range from more than 2.5 mm to 5.0 mm, the developer is made remaining on the surface of the developer carrier with a developer remaining rate in a range from 20% to 40%.

6. The image forming unit according to claim 5, wherein the electrostatic latent image is developed with the developer while the developer is carried in a state that a weight amount of the developer per unit area is set to 0.45 to 0.75 $mg/cm^2$ on the surface of the elastic layer of the developer carrier.

7. The image forming unit according to claim 6, wherein the weight amount of the developer per unit area is set to 0.55 to 0.65 $mg/cm^2$ on the surface of the elastic layer of the developer carrier.

8. An image forming apparatus comprising: a first drive unit transmitting drive force to the image carrier via the first drive force transmission route to rotate the image carrier; a second drive unit transmitting drive force to the developer carrier via the second drive force transmission route to rotate the developer carrier; and the image forming unit as set forth in claim 5.

9. An image forming unit comprising:

an image carrier rotating by drive force transmitted via a first drive force transmission route and forming an electrostatic latent image on a surface thereof; and a developer carrier having an elastic layer carrying a developer on a surface thereof, rotating by drive force transmitted via a second drive force transmission route, and developing the electrostatic latent image with the developer, wherein the electrostatic latent image is developed with the developer under one of the following development conditions:

(a) when the elastic layer of the developer carrier is set to have a thickness of 0.5 mm the developer is made remaining on the surface of the developer carrier with a developer remaining rate in a range from 5% to 40%;

(b) when the elastic layer of the developer carrier is set to have a thickness in a range from more than 0.5 mm to 2.5 mm, the developer is made remaining on the surface of the developer carrier with a developer remaining rate in a range from 20% to 40%;

(c) when the elastic layer of the developer carrier is set to have a thickness in a range from from more than 2.5 mm to 3.0 mm, the developer is made remaining on the surface of the developer carrier with a developer remaining rate in a range from 30% to 40%; or (d) when the elastic layer of the developer carrier is set to have a thickness in a range from more than 3.0 mm to 5.0 mm, the developer is made remaining on the surface of the developer carrier with a developer remaining rate of 40%.

* * * * *